US006367390B1

(12) United States Patent
Okubo et al.

(10) Patent No.: US 6,367,390 B1
(45) Date of Patent: Apr. 9, 2002

(54) SEISMIC ISOLATION SYSTEM FOR A CRANE

(75) Inventors: Yoshiaki Okubo; Hiroshi Ikeda; Hideaki Harada, all of Hiroshima (JP)

(73) Assignee: Mitsubishi Heavy Industries, Inc., Tokyo (JP)

( * ) Notice: Subject to any disclaimer, the term of this patent is extended or adjusted under 35 U.S.C. 154(b) by 0 days.

(21) Appl. No.: 09/471,911

(22) Filed: Dec. 23, 1999

(30) Foreign Application Priority Data

Dec. 25, 1998 (JP) ..... 10-371583

(51) Int. Cl.[7] ..... B61F 5/00

(52) U.S. Cl. ..... 105/163.1; 52/167.7; 52/167.1; 52/167.8; 212/299; 212/253; 248/638

(58) Field of Search ..... 105/163.1, 218.1, 105/218.2, 220, 209, 28; 248/638, 678; 52/167.5, 167.7, 167.8, 167.1; 212/180, 223, 253, 71, 272, 231, 299; 104/98

(56) References Cited

U.S. PATENT DOCUMENTS

| | | | | |
|---|---|---|---|---|
| 2,784,850 A | * | 3/1957 | Batson et al. | 212/299 |
| 3,377,088 A | * | 4/1968 | Millay et al. | 287/87 |
| 4,220,096 A | * | 9/1980 | Horowitz | 105/163.1 |
| 4,382,143 A | * | 5/1983 | Kakehi et al. | 105/163.1 |
| 4,573,592 A | * | 3/1986 | Oliphant | 212/182 |
| 4,599,834 A | * | 7/1986 | Fujimoto et al. | 52/167.7 |
| 5,176,267 A | * | 1/1993 | Pech | 212/180 |
| 5,233,800 A | * | 8/1993 | Sasaki et al. | 52/167.7 |
| 5,324,117 A | * | 6/1994 | Matsushita et al. | 384/36 |
| 5,797,228 A | * | 8/1998 | Kemeny | 52/167.7 |
| 5,842,589 A | * | 12/1998 | Kroll et al. | 212/299 |
| 6,010,018 A | * | 1/2000 | Pech | 212/292 |

FOREIGN PATENT DOCUMENTS

| | | | |
|---|---|---|---|
| GB | 2326629 A | * | 6/1997 |
| JP | 53-140756 | | 12/1978 |
| JP | 06-200657 | | 7/1994 |
| JP | 8-277091 | | 10/1996 |
| JP | 8-33081 | | 12/1996 |
| JP | 10-008765 | | 1/1998 |
| JP | 63-356 | | 2/2000 |

OTHER PUBLICATIONS

Report of a Research of Earthquake–Proof Measures for Cargo Handling Equipment, Mar. 1996, Japan Cargo–Handling Mechanization Association.

* cited by examiner

*Primary Examiner*—Russell D. Stormer
*Assistant Examiner*—Lars A. Olson
(74) *Attorney, Agent, or Firm*—Alston & Bird LLP

(57) ABSTRACT

A seismic isolation system is provided with a swing bearing ring consisting of an upper ring and a lower ring, which are rotatable relatively, between a crane body and a traveling means. A lower vertical shaft of a block pivotally supported on saddles of the crane body is supported by a swing bearing provided at an eccentric position on the upper ring. An automatic restoring mechanism is provided which restores the swing of a horizontal lever, whose proximal end is installed to the upper ring of the swing bearing ring, around the centerline C2.

43 Claims, 20 Drawing Sheets

SEISMIC ISOLATION SYSTEM FOR A CRANE

BACKGROUND OF THE INVENTION AND RELATED ART STATEMENT

1. Field of the Invention

The present invention relates to a seismic isolation system for a crane, which prevents derailment and the like of a large crane caused by an earthquake.

2. Description of Related Art

A "Overhead Traveling Crane" disclosed in Japanese Patent Publication No. 63-356 (No. 356/1988) is well known as a crane equipped with a seismic isolation system.

This "Overhead Traveling Crane" is, as shown in FIGS. 24 and 25, configured so that horizontal shafts 152 are mounted on saddles 151 on both sides of a narrow girder-shaped crane body 150, a track 154 having two traveling wheels 153 which travel on a rail 157 is provided on the horizontal shafts 152 so as to be slidable, and there is provided a vibration damping mechanism consisting of compression springs 155 and dampers 156, which are disposed between the opposed faces of the inside face of the saddle 151 and the track 154 so as to be parallel with the horizontal shafts 152.

On the crane of this type having the girder-shaped crane body 150, if an earthquake occurs, the crane body 150 is mainly subjected to only an excitation force perpendicular to the crane traveling direction as a dangerous external force, and the excitation force in this direction is damped by the action of the compression springs 155 and the dampers 156 to prevent the wheels from being damaged or derailed.

On a large container crane, an unloader, and the like provided on the ground, a crane body 1 is generally formed into a portal type as shown in FIGS. 17 and 18. These figures show a general construction of a container crane. This portal crane body 1 has traveling means 2 at four corners.

The traveling crane having such a portal crane body is subjected to a transverse excitation force R perpendicular to the travel direction, a transverse overturning moment M, a torsional load S (rotary load) from the travel direction to the right and left, and an impulsive axial load A by vibrations at the time of an earthquake.

Also, on the traveling crane having a large portal crane body, the height of the position of the center of gravity is very high, and therefore the natural period is long as compared with the overhead traveling crane, so that the transverse displacement of the portal crane body also increases. Therefore, even if the conventional vibration damping mechanism shown in FIG. 25 is applied to the portal crane body, a stroke necessary for damping the transverse excitation force R cannot be provided, and also damping action against the overturning moment M and the torsional load S cannot be provided.

OBJECT AND SUMMARY OF THE INVENTION

The present invention has been made in view of the above situation, and accordingly an object thereof is to provide a seismic isolation system for a crane, which is effective even for a traveling crane having a portal crane body.

To achieve the above object, the present invention provides a seismic isolation system for a crane, provided between a crane body and traveling means having a plurality of wheels for running the crane body along a rail, comprising: a connecting mechanism which allows relative movement of the crane body and the traveling means while the crane body and the traveling means are connected to each other when an earthquake occurs; a restraining mechanism which keeps a steady relative positional relationship between the crane body and the traveling means at the normal time and allows a relative movement of the crane body and the traveling means when the relationship is broken off by a seismic force; energy absorbing means for restraining an increase in relative movement of the crane body and the traveling means caused by the occurrence of an earthquake; and a restoring mechanism for restoring the positional relationship between the crane body and the traveling means to the steady relationship.

In the above-described seismic isolation system for a crane in accordance with the present invention, the steady positional relationship between the crane body and the traveling means is kept by the restraining mechanism at the normal time. When an earthquake occurs, however, the traveling means is displaced transversely, and the crane body attempts to remain at the original position by the inertia force, so that the restraining mechanism is released by the seismic force. Therefore, a relative movement of the crane body and the traveling means occurs, and the energy caused by the relative movement is absorbed by the energy absorbing means. The relative movement of the crane body and the traveling means is relaxed properly by a damper mounted between the crane body and the traveling means. Thus, the seismic isolation function is fulfilled safely and properly.

Also, the present invention provides a seismic isolation system for a crane, provided between a crane body and traveling means having a plurality of wheels for running the crane body along a rail, comprising a swing bearing ring consisting of a lower ring installed horizontally on the side of the traveling means and an upper ring engaging concentrically with the lower ring so as to be rotatable relatively, and further comprising a vertical shaft supporting swing bearing provided at an eccentric position on the upper ring of the swing bearing ring; a crane load supporting block having a lower vertical shaft supported on the swing bearing; saddles installed at the lower part of the crane body so as to pivotally support the block by using a horizontal transverse shaft; a horizontal lever whose proximal end is pivotally supported on the upper ring of the swing bearing ring through the horizontal transverse shaft; and a horizontal lever swing restoring mechanism which automatically restores the horizontal lever to the neutral position while supporting the distal end of the horizontal lever so as to be rotatable around the vertical centerline of the swing bearing ring.

In the above-described seismic isolation system for a crane in accordance with the present invention, the load of the crane body is transmitted from the saddles installed on the crane body to the traveling means through the crane load supporting block, the swing bearing, and the swing bearing ring.

An axial load, a overturning moment load, and a radial load applied to the crane body by an earthquake during the operation of the crane are supported by the swing bearing ring and the swing bearing on the traveling means.

Also, an excitation force applied in the radial direction perpendicular to the travel direction of the traveling means acts on the lower ring of the swing bearing ring on the traveling means so as to turn the swing bearing, which is erected at an eccentric position from the center of the swing bearing ring, around the vertical centerline of the swing bearing ring together with the horizontal lever. This turning force is automatically restrained by the horizontal lever swing restoring mechanism provided between the horizontal lever and the traveling means, whereby a damping operation against the excitation force is performed.

In the seismic isolation system for a crane in accordance with the present invention, the horizontal lever swing restoring mechanism comprises a roller which is provided at the distal end of the horizontal lever so as to be rotatable freely along the swing direction, and a guide rail provided on the traveling means so as to be inclined downward toward the middle position of the rail, which is the neutral position.

When the guide rail for guiding the roller (or a wheel) at the distal end of the horizontal lever mounted on the swing bearing ring is provided so as to be inclined downward from both sides thereof toward the rail middle position, which is the neutral position, as described above, the operation in which the horizontal lever having been swung by seismic vibrations is automatically restored to the neutral position is performed properly when the roller having been pushed against the guide rail by the gravity of the crane body is automatically restored to the rail middle position. Also, when the horizontal lever is swung by seismic vibrations, the roller climbs the inclined face of the guide rail, so that the swinging motion of the horizontal lever is restrained.

Also, in the seismic isolation system for a crane in accordance with the present invention, the horizontal lever swing restoring mechanism is composed of a laminated rubber mounted between the lower face of the horizontal lever and the upper face of the traveling means.

When the horizontal lever swing restoring mechanism is composed of the laminated rubber mounted between the lower face of the horizontal lever and the upper face of the traveling means as described above, the swinging motion of the horizontal lever is properly restrained by the spring effect and damping effect of the laminated rubber itself, and the operation in which the horizontal lever is automatically restored to the swing amount zero position (neutral position) is performed properly.

Further, in the seismic isolation system for a crane in accordance with the present invention, the horizontal lever swing restoring mechanism comprises a coil spring mounted between the lower face of the horizontal lever and the upper face of the traveling means, and an antifriction guide member interposed between the horizontal lever and the traveling means so as to guide the distal end of the horizontal lever in the swing direction of the lever along the upper face of the traveling means.

When the horizontal lever swing restoring mechanism is composed of the coil spring mounted between the lower face of the horizontal lever and the upper face of the traveling means as described above, as well, the swinging motion of the horizontal lever is elastically restrained properly by the coil spring at the time of an earthquake along with the operation of the antifriction guide member such as a roller for guiding the horizontal lever in the lever swing direction along the upper face of the traveling means. Also, the operation in which the horizontal lever having been swung by seismic vibrations is automatically restored to the neutral position is performed properly by the automatic restoring function of the coil spring.

Also, in the seismic isolation system for a crane in accordance with the present invention, braking means for braking the swinging motion of the horizontal lever is provided on the traveling means.

When the braking means for braking the swinging motion of the horizontal lever is provided as described above, an active damping operation is performed when an earthquake occurs.

Further, in the seismic isolation system for a crane in accordance with the present invention, a damper (hydraulic vibration exciter) for restraining the swinging motion of the horizontal lever is mounted between the traveling means and the horizontal lever. Therefore, the operation in which the swinging motion of the horizontal lever is restrained is performed sufficiently even by the use of such a damper, whereby the operation for actively damping the crane body can be performed when seismic vibrations occur.

Also, the present invention provides a seismic isolation system for a crane, provided between a crane body and traveling means having a plurality of wheels for running the crane body along a rail, comprising: a laminated rubber mounted between the lower face of the crane body and the central portion of the traveling means; and transverse slide mechanisms mounted between the lower face of the crane body and the upper face of the traveling means at longitudinally symmetrical positions with respect to the laminated rubber.

In the above-described seismic isolation system for a crane in accordance with the present invention, when a transverse excitation force is applied to the crane body by an earthquake, the crane body slides transversely while supporting a bending moment by using the transverse slide mechanisms. At this time, the sliding force between the crane body and the traveling means is absorbed by the deflection of the laminated rubber, and the crane body is automatically restored to the normal position with respect to the traveling means by the restoring force of the laminated rubber.

In the seismic isolation system for a crane in accordance with the present invention, a damper for restraining the transverse slide amount is mounted between the crane body and the traveling means. Therefore, the transverse movement of the crane body is restrained properly when seismic vibrations occur, along with the operation in which the transverse slide amount is restrained by such a damper.

Also, in the seismic isolation system for a crane in accordance with the present invention, there are provided a vibration detecting sensor for detecting vibrations of the crane body and the traveling means when an earthquake occurs, a vibration control section which sends a control signal for restraining the vibrations of the crane body in response to a detection signal sent from the sensor, and driving means which operates between the crane body and the traveling means so as to restrain the vibrations of the crane body according to the control signal sent from the vibration control section.

In the above-described seismic isolation system for a crane in accordance with the present invention, vibrations of the traveling means are detected by the vibration detecting sensor and taken in the vibration control section when seismic vibrations occur, and the driving means is controlled by the control signal sent from the control section so that the crane body is isolated from the vibrations of the traveling means. Therefore, the transverse vibrations of the crane body caused by an earthquake are restrained actively.

Further, the present invention provides a seismic isolation system for a crane, provided between a crane body and traveling means having a plurality of wheels for running the crane body along a rail, wherein the lower part of the crane body and the upper center of the traveling means are connected to each other by a universal joint mechanism, and vibration damping mechanisms, which connect the crane body to the traveling means, are interposed at positions on both sides of the universal joint mechanism.

In the above-described seismic isolation system for a crane in accordance with the present invention, the vibration damping mechanisms located on both sides of the universal joint mechanism are balanced mutually so as to keep the universal joint block vertical at the normal time. In this state, the weight of the crane body is transmitted as an axial load to the traveling means through the universal joint mechanism.

Also, the axial load, the overturning load, and the radial load applied to the crane body when seismic vibrations occur are also transmitted similarly to between the traveling means and the crane body through the universal joint mechanism.

A transverse excitation force applied to the crane body perpendicularly to the travel direction by seismic vibrations is absorbed as vibrations with a long vibration period by the turning motion of the crane body around the longitudinal horizontal axis in the universal joint mechanism.

Also, when the vibration damping mechanisms, which connect the crane body to the traveling means, are interposed at longitudinally symmetrical positions with respect to the universal joint mechanism, a longitudinal excitation force applied to the crane body by seismic vibrations is also damped properly.

Further, when the universal joint mechanism comprises saddles projecting downward from the lower part of the crane body, a universal joint block whose upper part is pivotally mounted to the saddles via a shaft in the travel direction, and a lower pivotally mounting portion which pivotally mounts the lower part of the universal joint block to a bearing on the traveling means via a horizontal transverse shaft, the construction of the universal joint mechanism is compact and has a high strength, and the arrangement thereof is effected properly.

Further, the present invention provides a seismic isolation system for a crane, provided between a crane body and traveling means having a plurality of wheels for running the crane body along a rail, comprising a laminated rubber mounted between the lower face of the crane body and the central portion of the traveling means; and turnover preventive restraining members interposed between the lower face of the crane body and the upper face of the traveling means at positions on both sides of the laminated rubber.

In the above-described seismic isolation system for a crane in accordance with the present invention, a transverse relative displacement produced between the crane body and the traveling means by an earthquake is absorbed by the spring element and the friction damping due to the deformation of the laminated rubber. At the same time, the overturning moment load applied along with the transverse radial load is supported by the resisting force of the turnover preventive restraining members on both sides, and the restoring operation to the deflection zero position is performed properly by the restoring force of the laminated rubber.

Also, in the seismic isolation system for a crane in accordance with the present invention, a trigger mechanism for restraining the horizontal relative displacement between the crane body and the traveling means is provided between the crane body and the traveling means, and when the trigger mechanism is subjected to an excitation force having a given value or larger by an earthquake, the restraint of relative displacement is released.

In the above-described seismic isolation system for a crane, when an excitation force exceeding the given value is applied to the crane by an earthquake, the trigger mechanism is released, and the seismic isolation function is fulfilled by the laminated rubber and the turnover preventive restraining members on both sides of the laminated rubber. In the normal state in which no earthquake occurs, the crane body and the traveling means are connected to each other integrally by the trigger mechanism, so that the rigidity of the whole crane is maintained.

Also, the present invention provides a seismic isolation system for a crane, provided between a crane body and traveling means having a plurality of wheels for running the crane body along a rail, comprising inclined guide means which guides the relative movement of the crane body when the traveling means is displaced transversely by a seismic force when an earthquake occurs, and additionally provides a restoring function, the inclined guide means comprising a first swing bearing ring consisting of a lower ring mounted on the traveling means in an inclined state and an upper ring engaging concentrically with the lower ring so as to be rotatable relatively; an inclined beam provided integrally with the upper ring of the first swing bearing ring; a second swing bearing ring consisting of a lower ring mounted on the upper face of the inclined beam so as to have the rotation centerline at a position shifted horizontally from the rotation centerline of the first swing bearing ring and an upper ring engaging concentrically with the lower ring so as to be rotatable relatively; and a crane body connecting portion for connecting the upper ring of the second swing bearing ring to the lower part of the crane body.

In the above-described seismic isolation system for a crane in accordance with the present invention, the load of the crane body is supported via the first swing bearing on the side of the traveling means, the inclined beam at the middle part, and the second swing bearing ring on the side of the crane body, and further via the crane body connecting portion.

When the traveling means moves in the transverse direction together with the rail at the time of the occurrence of earthquake, since the first swing bearing ring and the second swing bearing ring have the mutually shifted respective rotation centerlines, the crane body attempts to remain by the inertia force and shifts transversely relative to the traveling means. Accordingly, the inclined beam is swung and pushes up the crane body in cooperation with the second swing bearing ring on the beam. Thus, the crane body mainly moves vertically due to the reciprocating transverse movement of the traveling means caused by an earthquake, so that the period of the crane body is made long, and the seismic isolation function is fulfilled.

Further, in the seismic isolation system for a crane in accordance with the present invention, the crane body connecting portion comprises a hinge pin type connecting member and a hydraulic cylinder each of which is mounted between the upper ring of the second swing bearing ring and the crane body.

When the upper ring of the second swing bearing ring and the crane body are connected to each other by the hinge pin type connecting member and the hydraulic cylinder so that the inclination is adjustable as described above, the crane body can be kept horizontal by the extending/contracting adjustment of the hydraulic cylinder according to the face angle of the inclined beam, and the relative relationship of the crane body with the second swing bearing ring can be fixed properly.

Also, in the seismic isolation system for a crane in accordance with the present invention, a restraining mechanism, which restrains the rotation of the inclined beam at the normal time and allows the rotation of the inclined beam when the restraint is released by the seismic force at the time of the occurrence of an earthquake, is mounted between the inclined beam and the traveling means, and a damper for restraining the rotation of the inclined beam is mounted between the inclined beam and the traveling means.

When the restraining mechanism such as a shear pin or a brake is provided between the inclined beam and the traveling means so that the restraining mechanism is released only when an earthquake occurs as described above, the inclined beam is fixed at the normal time, so that a stable operation is performed as in the case of the conventional crane equipment. When the restraining mechanism is released by the seismic force and the inclined beam is turned reciprocatively, since the damper is provided to restrain the turning of the inclined beam, the seismic energy is absorbed while the relative movement of the crane body and the traveling means is relaxed properly.

Further, the present invention provides a seismic isolation system for a crane, provided between a crane body and traveling means having a plurality of wheels for running the crane body along a rail, wherein a spring mechanism is provided between the crane body and the traveling means to elastically keep a steady positional relationship between the crane body and the traveling means; a movable connecting mechanism which connects the crane body to the traveling means while allowing the relative displacement of the crane body, which attempts to remain at the original position by the inertia force acting on the crane body when the traveling means vibrates transversely due to the occurrence of an earthquake, with respect to the traveling means and a damper for restraining a relative displacement between the crane body and the traveling means, which is effected via the spring mechanism, are interposed between the crane body and the traveling means, and the movable connecting mechanism comprises a fist swing bearing ring consisting of a lower ring mounted horizontally on the side of the traveling means and an upper ring engaging concentrically with the lower ring so as to be rotatable relatively, a horizontal beam provided integrally with the upper ring of the first swing bearing ring, a second swing bearing ring consisting of a lower ring mounted on the upper face of the horizontal beam so as to have the rotation centerline at a position shifted horizontally from the rotation centerline of the first swing bearing ring and an upper ring engaging concentrically with the lower ring so as to be rotatable relatively, and a crane body connecting portion for connecting the upper ring of the second swing bearing ring to the lower part of the crane body.

In the above-described seismic isolation system for a crane in accordance with the present invention, in the movable connecting mechanism for connecting the crane body to the traveling means, the horizontal beam is provided in place of the inclined beam. Therefore, the relative movement caused between the traveling means and the crane body by the cooperative action of the horizontal beam and the first and second swing bearing rings below and above the horizontal beam when an earthquake occurs is effected only in the horizontal plane. The steady positional relationship between the traveling means and the crane body is kept by the spring mechanism, and the relative movement of the crane body and the traveling means, which is effected via the spring mechanism when an earthquake occurs, is relaxed by the damper. Thus, the seismic isolation function for the crane body is fulfilled properly while the seismic energy is absorbed.

In this case as well, the load of the crane body is supported without a difficulty through the first swing bearing ring on the side of the traveling means, the horizontal beam at the middle part, and the second swing bearing ring on the side of the crane body, and further through the crane body connecting portion.

Further, in the seismic isolation system for a crane in accordance with the present invention, a restraining mechanism, which restrains the rotation of the horizontal beam at the normal time and allows the rotation of the horizontal beam when the restraint is released by the seismic force at the time of the occurrence of an earthquake, is mounted between the horizontal beam and the traveling means.

When the restraining mechanism such as a shear pin or a brake is provided between the horizontal beam and the traveling means so that the restraining mechanism is released only when an earthquake occurs as described above, the horizontal beam is fixed at the normal time, so that a stable operation is performed as in the case of the conventional crane equipment.

As described in detail above, the seismic isolation system for a crane in accordance with the present invention achieves the following effects:

(1) The steady positional relationship between the crane body and the traveling means are held by the restraining mechanism at the normal time. When an earthquake occurs, the traveling means is displaced transversely, and the crane body attempts to remain by the inertia force. When the restraining mechanism is released by the seismic force, a relative movement of the crane body and the traveling means takes place, and the energy due to the relative movement is absorbed by the energy absorbing means. the relative movement (vibration) of the crane body and the traveling means is properly relaxed by the damper mounted between the crane body and the traveling means. Thus, the seismic isolation function is fulfilled safely and properly. (Claim 1)

(2) The load of the crane body is transmitted from the saddles installed to the crane body to the traveling means through the crane load supporting block, the swing bearing, and the swing bearing ring. An axial load, overturning load, and radial load applied to the crane body by seismic vibrations during the operation of the crane are supported by the swing bearing ring and the swing bearing on the traveling means. An excitation force applied in the radial direction perpendicular to the travel direction of the traveling means acts on the lower ring of the swing bearing ring on the traveling means so as to turn the swing bearing, which is erected at an eccentric position from the center of the swing bearing ring, around the vertical centerline of the swing bearing ring together with the horizontal lever. This turning force is automatically restrained by the horizontal lever swing restoring mechanism provided between the horizontal lever and the traveling means, whereby a damping operation against the excitation force is performed. (Claim 2)

(3) When the guide rail for guiding the roller (or the wheel) at the distal end of the horizontal lever mounted on the swing bearing ring is provided so as to be inclined downward from both sides thereof toward the rail middle position, which is the neutral position, the operation in which the horizontal lever having been swung by seismic vibrations is automatically restored to the neutral position is performed properly when the roller having been pushed against the guide rail by the gravity of the crane body is automatically restored to the rail middle position. Also, when the horizontal lever is swung by seismic vibrations, the roller climbs the inclined face of the guide rail, so that the swinging motion of the horizontal lever is restrained. (Claim 3)

(4) When the horizontal lever swing restoring mechanism is composed of the laminated rubber mounted between the lower face of the horizontal lever and the upper face of the traveling means, the swinging motion of the horizontal lever is properly restrained by the spring effect and damping effect of the laminated rubber itself, and the operation in which the horizontal lever is automatically restored to the swing amount zero position (neutral position) is performed properly. (Claim 4)

(5) When the horizontal lever swing restoring mechanism is composed of the coil spring mounted between the lower face of the horizontal lever and the upper face of the traveling means, as well, the swinging motion of the horizontal lever is elastically restrained properly by the coil spring at the time of an earthquake along with the operation of the antifriction guide member such as a roller for guiding the horizontal lever in the lever swing direction along the upper face of the traveling means. Also, the operation in which the horizontal lever having been swung by seismic vibrations is automatically restored to the neutral position is performed properly by the automatic restoring function of the coil spring. (Claim 5)

(6) When the braking means for braking the swinging motion of the horizontal lever is provided, an active damping operation is performed when an earthquake occurs. (Claim 6)

(7) The operation in which the swinging motion of the horizontal lever is restrained is performed sufficiently even by the use of such a damper (vibration exciter), whereby the operation for actively damping the crane body can be performed when seismic vibrations occur. (Claim 7)

(8) When there are provided the laminated rubber mounted between the lower face of the crane body and the central portion of the traveling means and the transverse slide mechanisms mounted between the lower face of the crane body and the upper face of the traveling means at longitudinally symmetrical positions with respect to the laminated rubber, the crane body slides transversely while supporting a bending moment by using the transverse slide mechanisms when a transverse excitation force is applied to the crane body by an earthquake. At this time, the sliding force between the crane body and the traveling means is absorbed by the deflection of the laminated rubber, and the crane body is automatically restored to the normal position with respect to the traveling means by the restoring force of the laminated rubber. (Claim 8)

(9) When the oil damper for restraining the transverse slide amount is mounted between the crane body and the traveling means, the transverse movement of the crane body is restrained properly when seismic vibrations occur, along with the operation in which the transverse slide amount is restrained by the oil damper. (Claim 9)

(10) Vibrations of the crane body with respect to the traveling means are detected by the vibration detecting sensor and taken in the vibration control section when seismic vibrations occur, and the driving means is controlled by the control signal sent from the control section so that the crane body is isolated from the vibrations of the traveling means. Thereby, the transverse vibrations of the crane body caused by an earthquake are damped actively. (Claim 10)

(11) When the lower part of the crane body and the upper center of the traveling means are connected to each other by the universal joint mechanism, and the vibration damping mechanisms, which connect the crane body to the traveling means, are interposed at positions on both sides of the universal joint mechanism, a transverse excitation force applied to the crane body perpendicularly to the travel direction by seismic vibrations is absorbed as vibrations with a long vibration period by the turning motion of the crane body around the longitudinal horizontal axis in the universal joint mechanism. (Claim 11)

(12) When the vibration damping mechanisms, which connect the crane body to the traveling means, are interposed at longitudinally symmetrical positions with respect to the universal joint mechanism, a longitudinal excitation force applied to the crane body by seismic vibrations is also damped properly. (Claim 12)

(13) When the universal joint mechanism comprises saddles projecting downward from the lower part of the crane body, a universal joint block whose upper part is pivotally mounted to the saddles via a shaft in the travel direction, and a lower pivotally mounting portion which pivotally mounts the lower part of the universal joint block to a bearing on the traveling means via a horizontal transverse shaft, the construction of the universal joint mechanism is compact and has a high strength, and the arrangement thereof is effected properly. (Claim 13)

(14) When there are provided the laminated rubber mounted between the lower face of the crane body and the central portion of the traveling means and the turnover preventive restraining members interposed between the lower face of the crane body and the upper face of the traveling means at positions on both sides of the laminated rubber, a transverse relative displacement produced between the crane body and the traveling means by an earthquake is absorbed by the spring effect and the friction damping due to the deformation of the laminated rubber. At the same time, the overturning moment load applied along with the transverse radial load is supported by the resisting force of the turnover preventive restraining members on both sides, and the restoring operation to the deflection zero position is performed properly by the restoring force of the laminated rubber. (Claim 14)

(15) When the laminated rubber and the turnover preventive restraint members on both sides of the laminated rubber are provided, and also the trigger mechanism is provided between the crane body and the traveling means, the trigger mechanism is released when an excitation force exceeding the given value is applied to the crane by an earthquake, and the seismic isolation function is fulfilled by the laminated rubber and the turnover preventive restraining members on both sides of the laminated rubber. In the normal state in which no earthquake occurs, the crane body and the traveling means are connected to each other integrally by the trigger mechanism, so that the rigidity of the whole crane is maintained. (Claim 15)

(16) The load of the crane body is supported via the first swing bearing on the side of the traveling means, the inclined beam at the middle part, and the second swing bearing ring on the side of the crane body, and further via the crane body connecting portion. When the traveling means moves in the transverse direction together with the rail at the time of the occurrence of earthquake, since the first swing bearing ring and the second swing bearing ring have the mutually shifted respective rotation centerlines, the crane body attempts to remain by the inertia force and shifts transversely relative to the traveling means. Accordingly, the inclined beam is swung and pushes up the crane body in cooperation with the second swing bearing ring on the beam. Thus, the crane body mainly moves vertically due to the reciprocating transverse movement of the traveling means caused by an earthquake, so that the period of the crane body is made long, and the seismic isolation function is fulfilled. (Claim 16)

(17) When the upper ring of the second swing bearing ring and the crane body are connected to each other by the hinge pin type connecting member and the hydraulic cylinder so that the inclination is adjustable, the crane body can be kept horizontal by the extending/contracting adjustment of the hydraulic cylinder according to the face angle of the inclined beam, and the relative relationship of the crane body with the second swing bearing ring can be fixed properly. (Claim 17)

(18) When the restraining mechanism such as a shear pin or a brake is provided between the inclined beam and the traveling means so that the restraining mechanism is released only when an earthquake occurs, the inclined beam is fixed at the normal time, so that a stable operation is performed as in the case of the conventional crane equipment. When the restraining mechanism is released by the seismic force and the inclined beam is turned reciprocatively, since the oil damper is provided to restrain the turning of the inclined beam, the seismic energy is absorbed while the relative movement of the crane body and the traveling means is relaxed properly. (Claim 18)

(19) In the movable connecting mechanism for connecting the crane body to the traveling means, the horizontal beam is provided in place of the inclined beam. Therefore, the relative movement caused between the traveling means and the crane body by the cooperative action of the horizontal beam and the first and second swing bearing rings below and above the horizontal beam when an earthquake occurs is effected only in the horizontal plane. The steady positional relationship between the traveling means and the crane body is kept by the spring mechanism, and the relative movement of the crane body and the traveling means, which is effected via the spring mechanism when an earthquake occurs, is relaxed by the oil damper. Thus, the seismic isolation function for the crane body is fulfilled properly while the seismic energy is absorbed. In this case as well, the load of the crane body is supported without a difficulty through the first swing bearing ring on the side of the traveling means, the horizontal beam at the middle part, and the second swing bearing ring on the side of the crane body, and further through the crane body connecting portion. (Claim 19)

(20) When the restraining mechanism such as a shear pin or a brake is provided between the horizontal beam and the traveling means so that the restraining mechanism is released only when an earthquake occurs, the horizontal beam is fixed at the normal time, so that a stable operation is performed as in the case of the conventional crane equipment. (Claim 20)

DETAILED DESCRIPTION OF PREFERRED EMBODIMENTS

Figure 1:
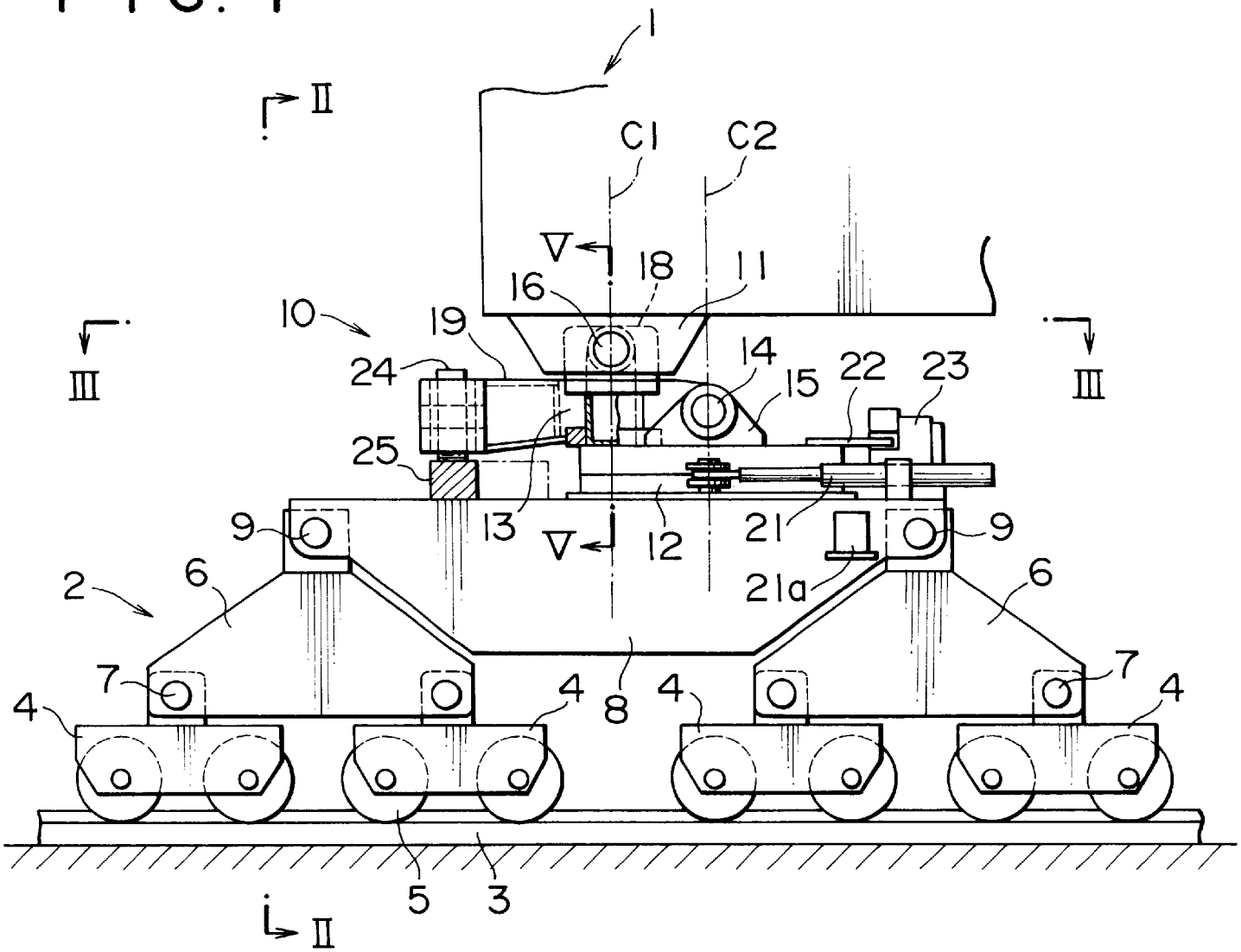
FIG. 1 is a side view of a seismic isolation system for a crane in accordance with a first embodiment of the present invention.
Figure 2:
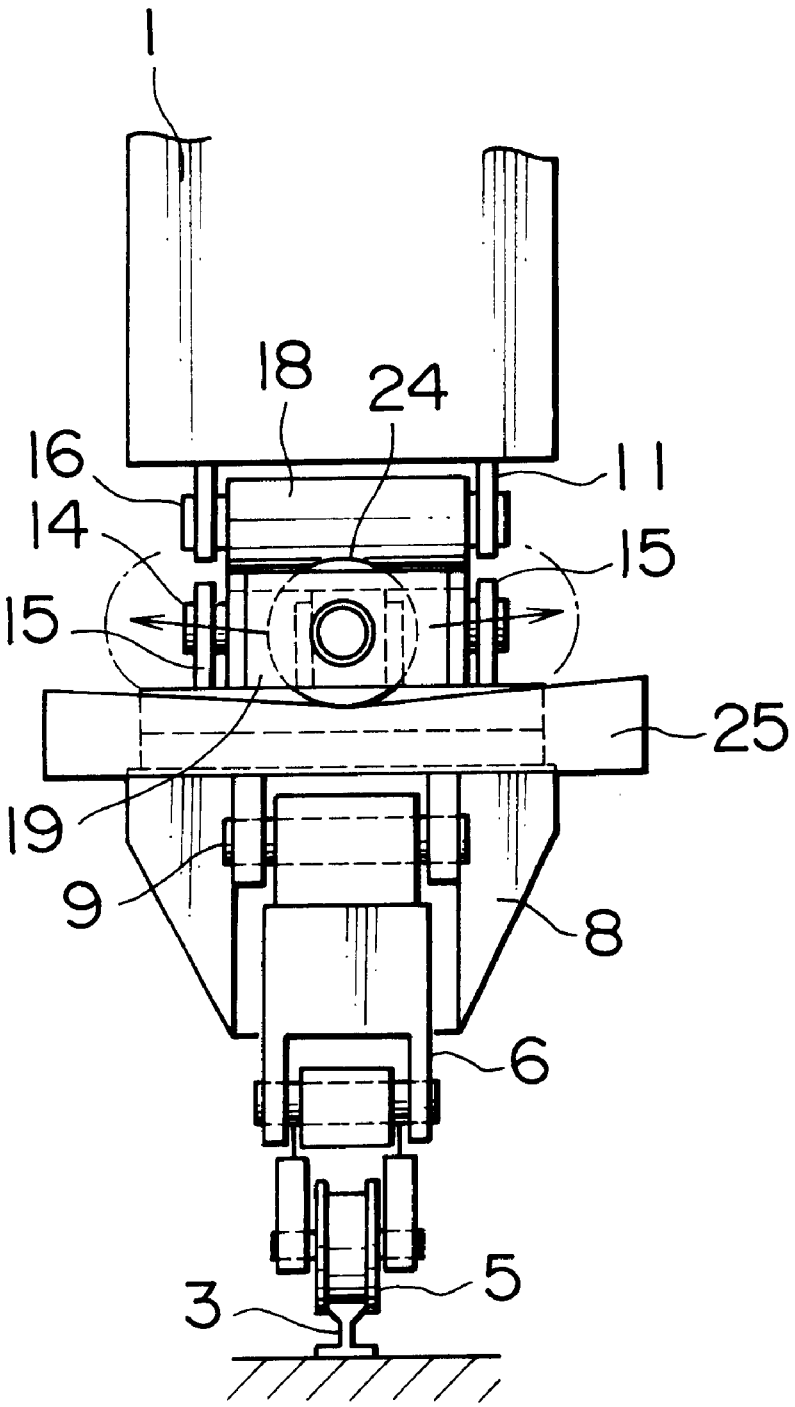
FIG. 2 is a view taken in the direction of the arrows along the line II—II of FIG. 1.
Figure 3:
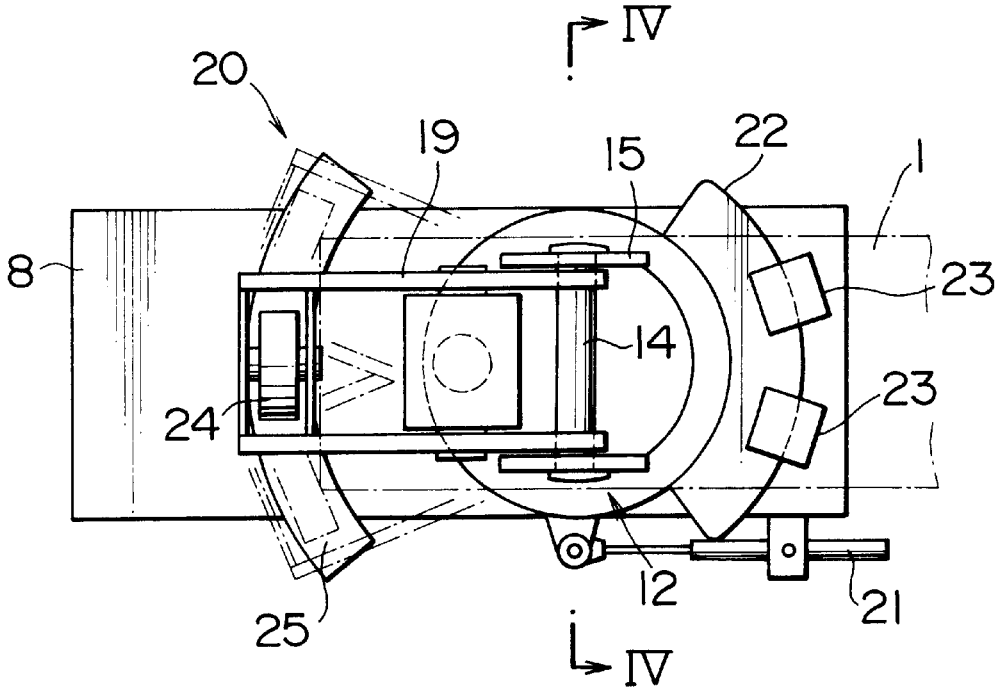
FIG. 3 is a view taken in the direction of the arrows along the line III—III of FIG. 1.
Figure 4:
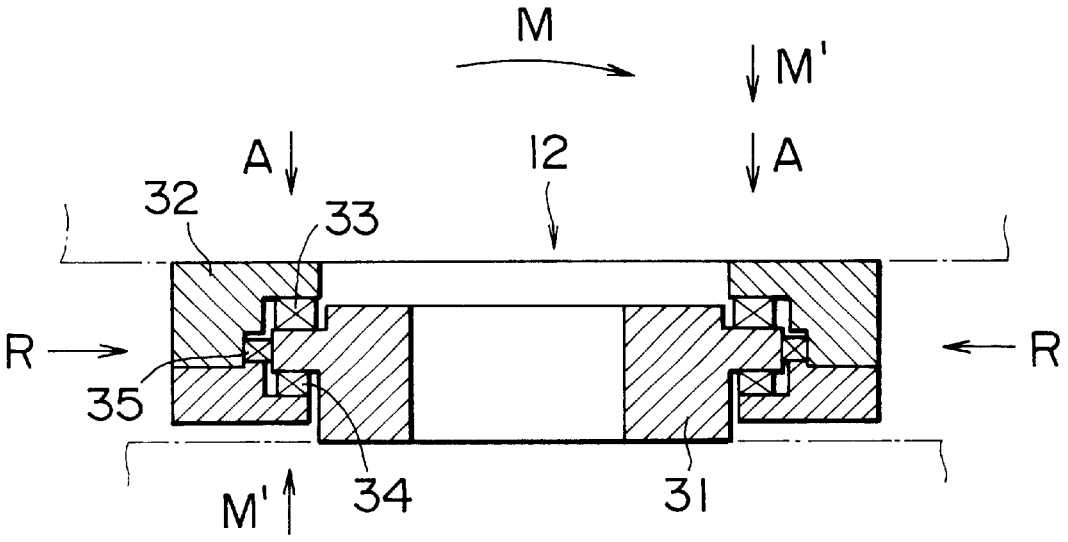
FIG. 4 is an enlarged sectional view taken in the direction of the arrows along the line IV—IV of FIG. 3.
Figure 5:
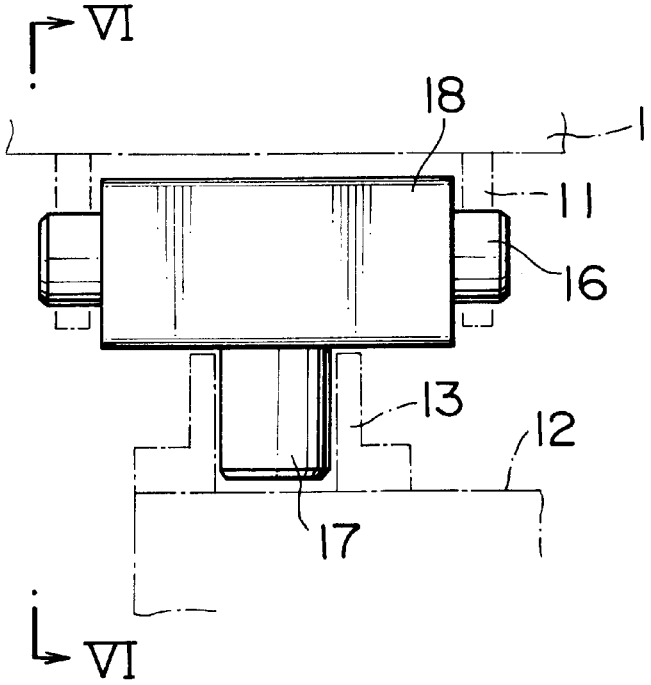
FIG. 5 is an enlarged view taken in the direction of the arrows along the line V—V of FIG. 1.
Figure 6:
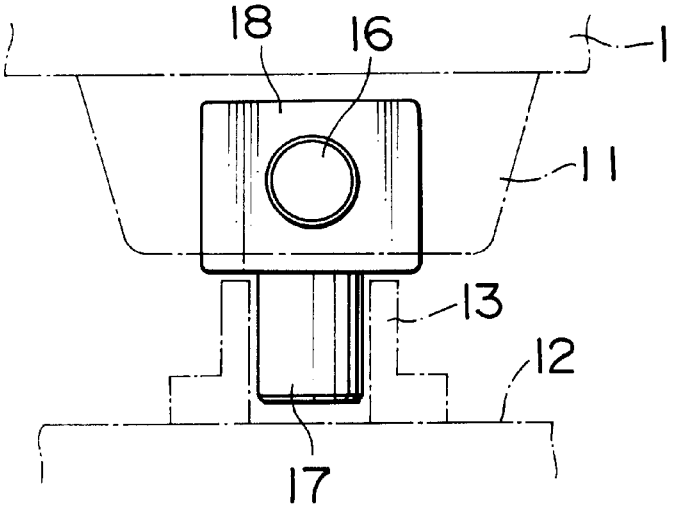
FIG. 6 is a view taken in the direction of the arrows along the line VI—VI of FIG. 5.

Embodiments of the present invention will now be described with reference to the accompanying drawings. FIG. 1 is a side view showing a state in which a seismic isolation system for a crane in accordance with a first embodiment of the present invention is provided between one traveling means provided at each of four corners of a crane body of a portal crane and the crane body. FIG. 2 is a view taken in the direction of the arrows along the line II—II of FIG. 1, FIG. 3 is a view taken in the direction of the arrows along the line III—III thereof, FIG. 4 is an enlarged sectional view taken in the direction of the arrows along the line IV—IV of FIG. 3, FIG. 5 is an enlarged view taken in the direction of the arrows along the line V—V of FIG. 1, and FIG. 6 is a view taken in the direction of the arrows along the line VI—VI of FIG. 5.

Figure 17:
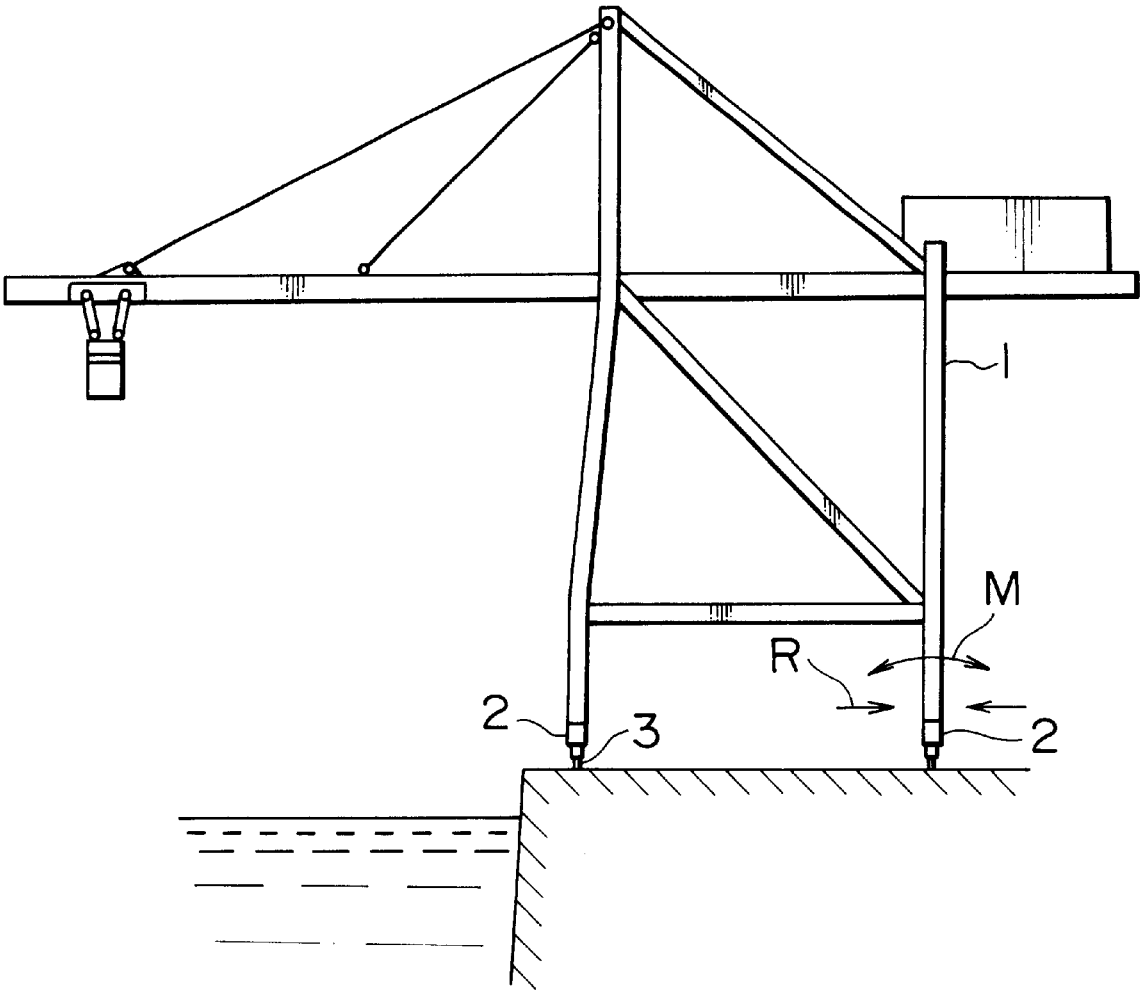
FIG. 17 is a front view of a traveling portal crane.
Figure 18:
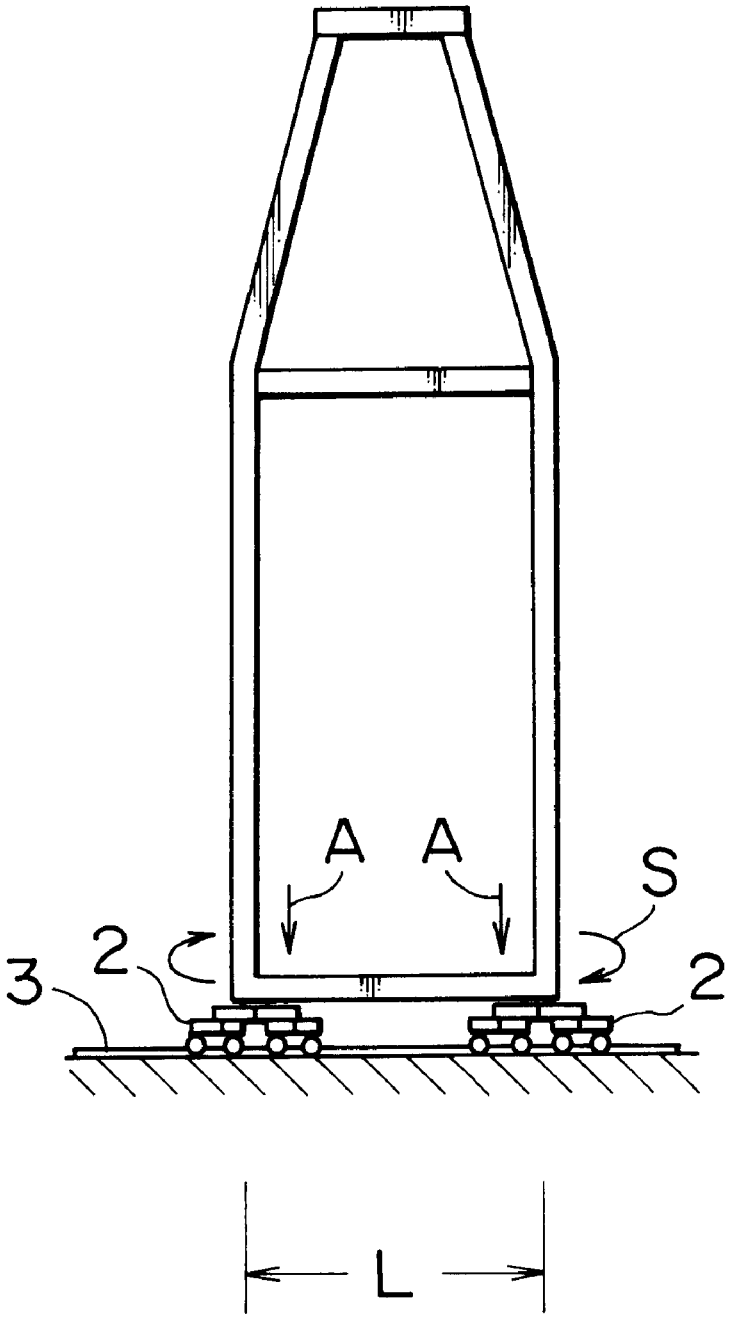
FIG. 18 is a side view of the traveling portal crane shown in FIG. 17.

The crane equipped with the seismic isolation system of this embodiment is constructed as a portal crane as shown in FIGS. 17 and 18, and is provided with a seismic isolation system 10 as shown in FIG. 1 between a portal crane body 1 and traveling means 2 at each of four corners thereof.

Specifically, as shown in FIG. 1, the traveling means 2 comprises four sets of tracks 4 each provided with two wheels 5 which travel on a rail 3, two sets of lower equalizer beams 6 each of which connects the adjacent two sets of tracks 4, 4 by using shafts 7, and an upper equalizer beam 8 which connects two sets of lower equalizer beams 6 by using shafts 9, and a seismic isolation system 10 of the first embodiment of the present invention is mounted between the upper equalizer beam 8 and the crane body 1.

In FIG. 1, reference numeral C1 denotes the centerline of the upper equalizer beam 8, and C2 denotes a position at which the seismic isolation system 10 is installed to the upper equalizer beam 8, which shifts toward the center of the crane body 1 through a fixed distance from the centerline C1.

The traveling means 2 of the portal crane is of types of various combinations in terms of the number of wheels which is different from the above description. Also, one set of the track 4 with two wheels is sometimes provided at each corner of the crane body 1. In the embodiments of the present invention, for each type of these traveling means 2, the seismic isolation system 10 is provided so as to connect the uppermost equalizer beam or track of the traveling means 2 to saddles 11 on the crane body 1.

As shown in FIGS. 1 to 4, the seismic isolation system 10 has a swing bearing ring 12 consisting of a lower ring 31 and an upper ring 32. The lower ring 31 is installed horizontally around the vertical centerline C1 on the upper equalizer beam 8 of the traveling means 2. The upper ring 32 engages concentrically with the lower ring 31 via bearings 33 and 34 for axial load and moment load and a bearing 35 for radial load so as to be rotatable relatively.

Also, as shown in FIGS. 5 and 6, a lower vertical shaft 17 of a crane load supporting block 18 is supported on a vertical shaft supporting swing bearing 13 provided along the centerline C1 at an eccentric position on the upper ring 32 of the swing bearing ring 12. The block 18 is pivotally carried on the saddles 11 installed on the crane body 1 through a horizontal transverse shaft 16. In this manner, the traveling means 2 is pivotally supported by the crane body 1 via the horizontal transverse shaft 16 as shown in FIG. 1.

The seismic isolation system 10 supports a horizontal transverse shaft 14, which is disposed in a direction along the diametric direction of the swing bearing ring 12 and meeting the centerline C2, via brackets 15 on the upper ring 32, and has a horizontal lever 19 supported by the horizontal transverse shaft 14. A horizontal lever swing restoring mechanism 20 is provided as shown in FIGS. 1 to 3, which automatically restores the position of the horizontal lever 19 to its neutral position (position along the crane traveling direction) while supporting the distal end of the horizontal lever 19 so that the distal end of the horizontal lever 19 is swung around the vertical centerline C2 of the swing bearing ring 12 together with the upper ring 32.

Specifically, a roller (including the case of a wheel) 24 is provided at the distal end of the horizontal lever 19, which roller 24 can rotate freely along the swing direction around the swing centerline C2 of the horizontal lever. Also, a guide rail 25 is provided on the upper equalizer beam 8 of the traveling means 2 to guide the roller 24. The guide rail 25 is inclined downward toward the middle position of the rail, which is the neutral position (see FIG. 2).

Also, an auxiliary driving type (or driven type) hydraulic damper 21 is provided between the upper ring 32 of the swing bearing ring 12 and the equalizer beam 8, and a drive unit 21*a* for the hydraulic damper 21 is provided.

Further, a braking plate 22 is provided on the side opposite to the horizontal lever 19 on the upper ring 32 of the swing bearing ring 12, and detachable brakes 23 are mounted on the braking plate 22. This constitutes braking means for braking the swinging motion of the horizontal lever 19.

The swing bearing 13 can be replaced with a small swing bearing ring similar to the swing bearing ring 12 to support the lower vertical shaft 17 of the load supporting block 18.

Figure 7:
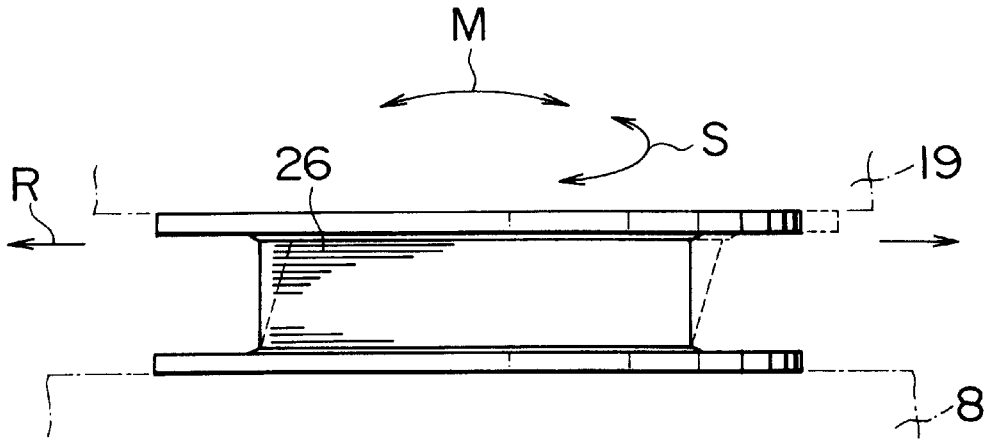
FIG. 7 is an explanatory view showing a modification of an essential portion of the system shown in FIG. 1.

The horizontal lever swing restoring mechanism 20 can use a construction such that a laminated rubber 26 for damping vibrations as shown in FIG. 7, which has generally been used to damp seismic vibrations of buildings, is provided between the lower face of the horizontal lever 19 and the upper face of the upper equalizer beam 8 in place of the combined construction of the roller 24 and the guide rail 25. Further, a coil spring can be used in place of the laminated rubber 26, and besides restoring means of any other construction can be used.

When the coil spring is used in place of the laminated rubber 26, a roller or a sliding bearing member, serving as an antifriction guide member, is additionally used to guide the horizontal lever 19 so that the distal end of the lever 19 is guided along the upper face of the traveling means 2, that is, the upper face of the upper equalizer beam 8.

The above-described seismic isolation system 10 is kept in a state in which the braking plate 22 is locked by the brakes 23 during the operation of the crane, and the brakes 23 are released when the operation of the crane is suspended, by which the seismic isolation system 10 can be kept in an operable state. It is preferable that the locking of the braking plate 22 by the brakes 23 can be released in response to an earthquake detection signal sent from a vibration detecting sensor (not shown) during the operation of the crane.

The load of the portal crane body 1 is transmitted from saddles 11 at four corners of the portal crane body 1 to the traveling means 2 including the upper equalizer beam 8 through the load supporting block 18, the swing bearing 13, and the swing bearing ring 12.

The excitation forces of axial load A, overturning moment loads M, M', and radial load R, which are applied to the portal crane body 1 by seismic vibrations during the operation of the crane, are absorbed by the swing bearing ring 12 on the traveling means 2 and the swing bearing 13.

At this time, the excitation force R applied in the radial direction perpendicular to the rail 3 acts so as to turn the swing bearing 13 eccentrically disposed from the swing bearing ring 12 of the traveling means 2 around the center of the swing bearing ring 12 together with the horizontal lever 19. This turning force is restrained by the horizontal lever swing restoring mechanism 20 provided between the horizontal lever 19 and the traveling means 2, whereby damping is achieved.

Since the horizontal lever swing restoring mechanism 20 is composed of the roller 24 provided at the distal end of the horizontal lever 19 shown in FIGS. 1 to 3 and a guide rail 25 inclined downward toward the middle position on the traveling means 2, the roller 24 moves on the face of the guide rail 25 in the downwardly inclined direction when the horizontal lever 19 is swung, so that the movement force is restrained, and the horizontal lever 19 returns to the middle position of the guide rail 25 automatically by means of the gravity of the crane.

When the horizontal lever restoring mechanism 20 is composed of the laminated rubber 26 shown in FIG. 7, the movement force of the horizontal lever 19 is restrained by the spring element, friction damping element, and viscosity damping element of the laminated rubber 26 itself, and then the horizontal lever 19 returns automatically to the turning amount zero position. When the coil spring is used in place of the laminated rubber 26, the movement force of the horizontal lever 19 is restrained by the spring element of the coil spring itself, and then the horizontal lever 19 returns automatically to the turning amount zero position.

Also, impulsive turning of the horizontal lever 19 caused by an earthquake can be restrained by the auxiliary hydraulic damper 21 as well. By using the driving type hydraulic damper 21, seismic vibrations can be damped actively. Further, since the braking means 22, 23 for restraining the swinging motion of the horizontal lever 19 is provided, the operation for damping earthquakes can be performed more properly.

The above-described operation is performed independently at the portion of traveling means 2 at four corners of the portal crane body, so that the seismic force acting on the portal crane can be absorbed safely by the traveling means 2.

Also, this configuration can provide a seismic isolation mechanism that can safely absorb a great horizontal swing torsion of a large portal crane body 1 by using a compact mechanism.

Further, since the seismic isolation system 10 consists of an independent mechanism disposed between the traveling means 2 and the saddles 11, maintenance, adjustment, and repair work can be done easily.

Figure 8:
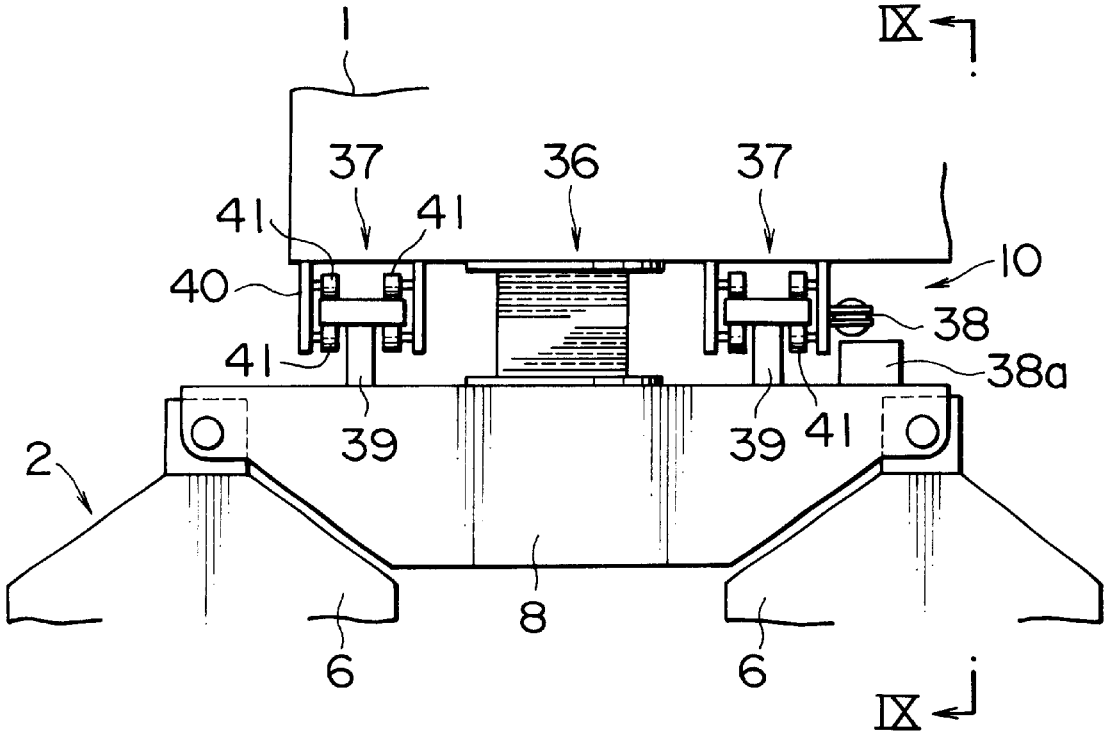
FIG. 8 is a side view of a seismic isolation system for a crane in accordance with a second embodiment of the present invention.
Figure 9:
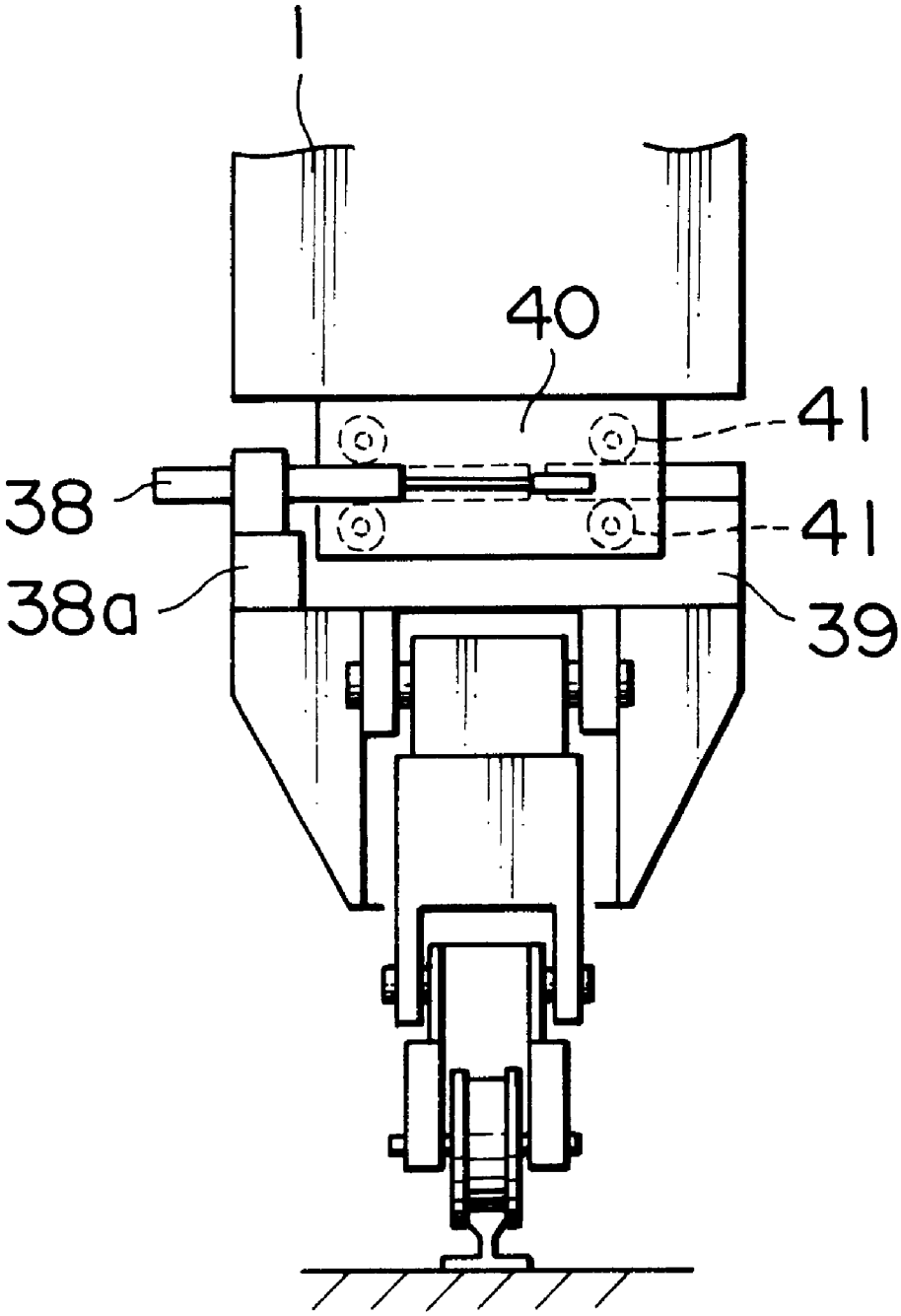
FIG. 9 is a view taken in the direction of the arrows along the line IX—IX of FIG. 8.

Next, a seismic isolation system for a crane in accordance with a second embodiment of the present invention will be described. FIG. 8 is a side view of the seismic isolation system, and FIG. 9 is a view taken in the direction of the arrows along the line IX—IX of FIG. 8.

In this second embodiment, on a traveling portal crane equipped with a portal crane body 1 and traveling means 2, similar to those in the above-described first embodiment, a seismic isolation system 10, which is interposed between the crane body 1 and the traveling means 2, is constructed as described below.

In this system, a laminated rubber 36 is mounted between the lower face of the crane body 1 and the central portion of an upper equalizer beam 8 of the traveling means 2, and a transverse slide mechanisms 37 are mounted at longitudinally symmetrical positions with respect to the laminated rubber 36 between the lower face of the crane body 1 and the upper face of the upper equalizer beam 8. Also, a hydraulic damper 38 for damping vibrations is provided between the slide portion of the crane body 1 and the upper equalizer beam 8.

As the laminated rubber 36, a laminated rubber having a necessary height and diameter is used to accommodate a transverse displacement occurring between the crane body 1 and the traveling means 2 when seismic vibrations occur.

The transverse slide mechanism 37 is composed of a rail 39 having a T-shaped cross section, which is fixed onto the upper equalizer beam 8, and four rollers 41, which are mounted on each of a pair of saddles 40 extending along both sides of the rail 39 from the crane body 1 and rotate while contacting with the upper and lower faces of the rail 39. The hydraulic damper (vibration exciter) 38 is provided in the transverse direction between the saddle 40 and the upper equalizer beam 8, and a drive unit 38*a* for the hydraulic damper 38 is provided.

In the above-described second embodiment, when the transverse excitation force R is applied to the crane by an earthquake, the crane body 1 slides transversely while the overturning bending moment load M is absorbed by the paired transverse slide mechanisms 37.

At this time, the mutual side forces are absorbed by the deflection of the laminated rubber 36, and the crane body 1 and the traveling means 2 are restored automatically to the slide zero position by the restoring force of the laminated rubber 36.

Also, at this time, the hydraulic damper 38 operates in parallel so as to damp the mutual slide forces. Other operation and effects are the same as in the case of the first embodiment.

Figure 10:
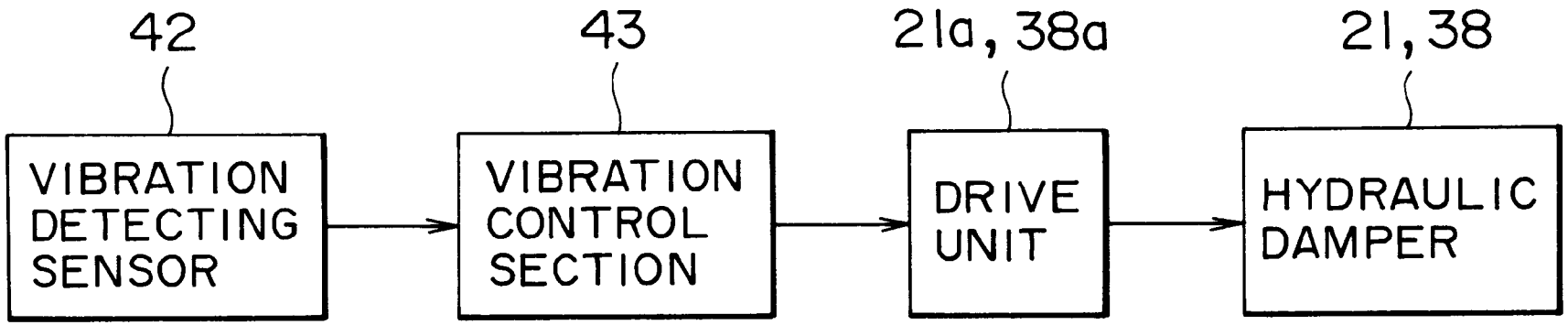
FIG. 10 is a block diagram of a control system provided for the seismic isolation systems for a crane shown in FIGS. 1 and 8.

The following is a description of a control system provided for the seismic isolation systems for a crane of the above-described first and second embodiments. As shown in FIG. 10, there are provided a vibration detecting sensor 42 mounted on the traveling means 2 and/or the crane body 1 of the first and second embodiments, the drive unit 21*a* for the hydraulic damper 21 (FIG.1) or the drive unit 38*a* for the hydraulic damper 38 (FIG.8), and a vibration control section 43 for controlling a drive unit for the roller or wheel 24.

In the seismic isolation systems of the above-described first and second embodiments, mutual vibrations of the traveling means 2 and the crane body 1 caused by an earthquake are detected by the vibration detecting sensor 42, and are taken in the vibration control section 43. The vibration control section 43 controls the drive unit 21*a* or 38*a* to restrain the velocity displacement, by which the transverse vibrations of the portal crane caused by an earthquake can be damped actively, so that the derailment etc. can be prevented.

Figure 11:
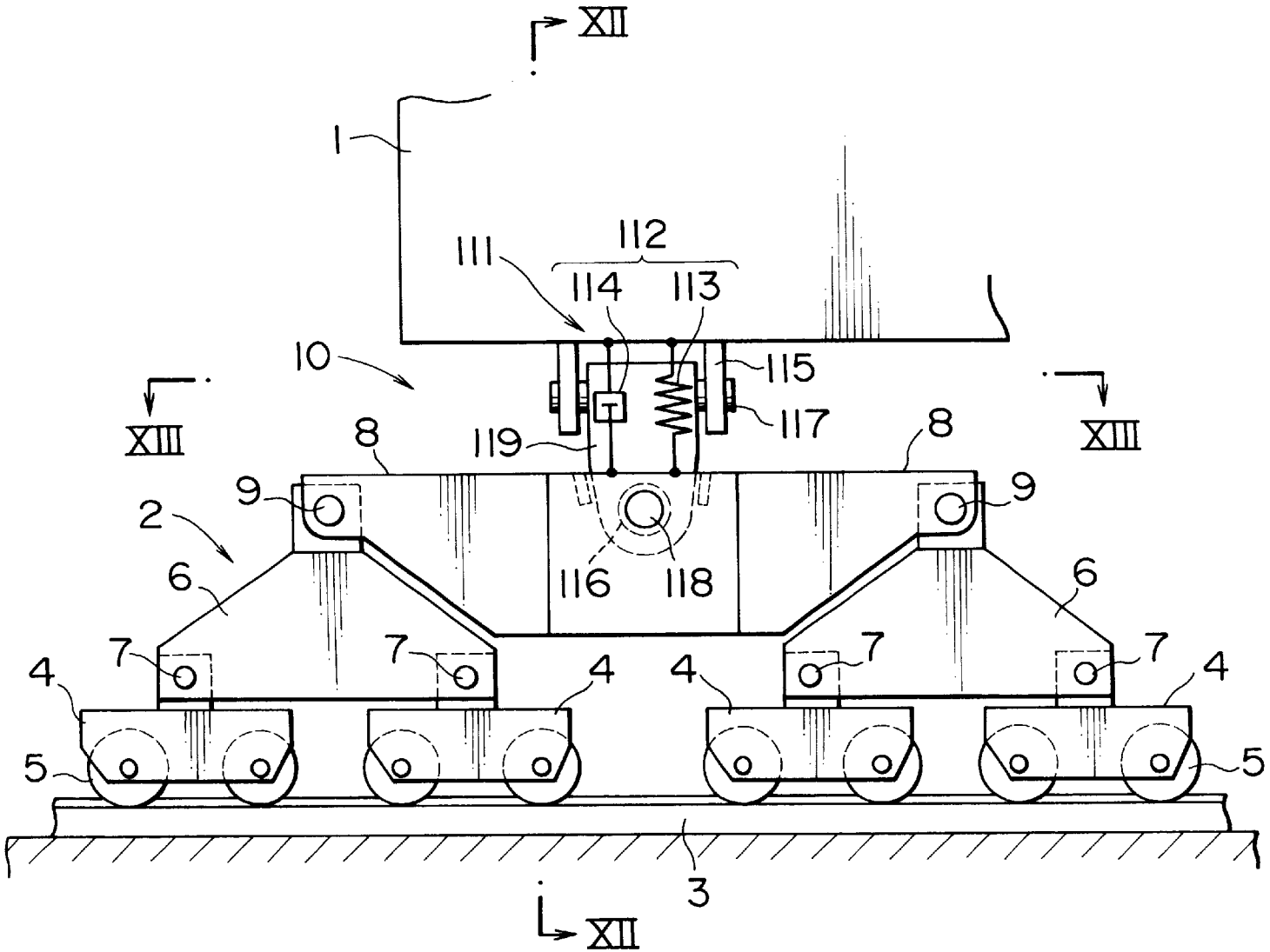
FIG. 11 is a side view of a seismic isolation system for a crane in accordance with a third embodiment of the present invention.

Next, a seismic isolation system for a crane in accordance with a third embodiment of the present invention will be described. FIG. 11 is a side view of the seismic isolation system, FIG. 12 is a sectional view taken in the direction of the arrows along the line XII—XII of FIG. 11, and FIG. 13 is a sectional view taken in the direction of the arrows along the line XIII—XIII of FIG. 11.

In this third embodiment as well, like the abovedescribed embodiments, traveling means 2 is provided at each of four corners of the crane body 1 of a portal crane. Specifically, as shown in FIG. 11, the traveling means 2 comprises four sets of tracks 4 each provided with two wheels 5 which travel on a rail 3, two sets of lower equalizer beams 6 each of which connects the adjacent two sets of tracks 4, 4 by using shafts 7, and an upper equalizer beam 8 which connects two sets of lower equalizer beams 6 by using shafts 9, and a seismic isolation system 10 of this embodiment is mounted between the upper equalizer beam 8 and the crane body 1.

Figure 12:
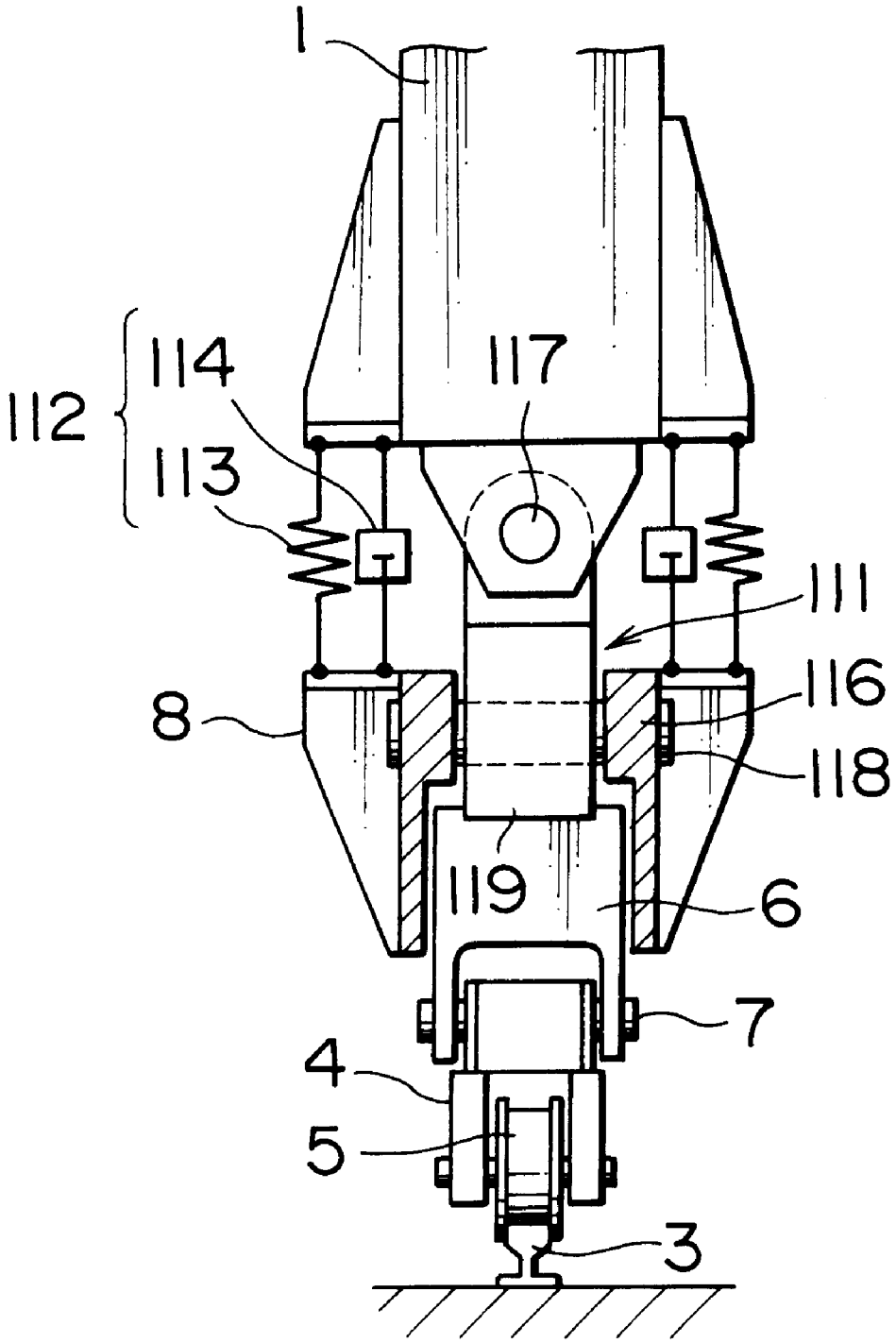
FIG. 12 is a sectional view taken in the direction of the arrows along the line XII—XII of FIG. 11.
Figure 13:
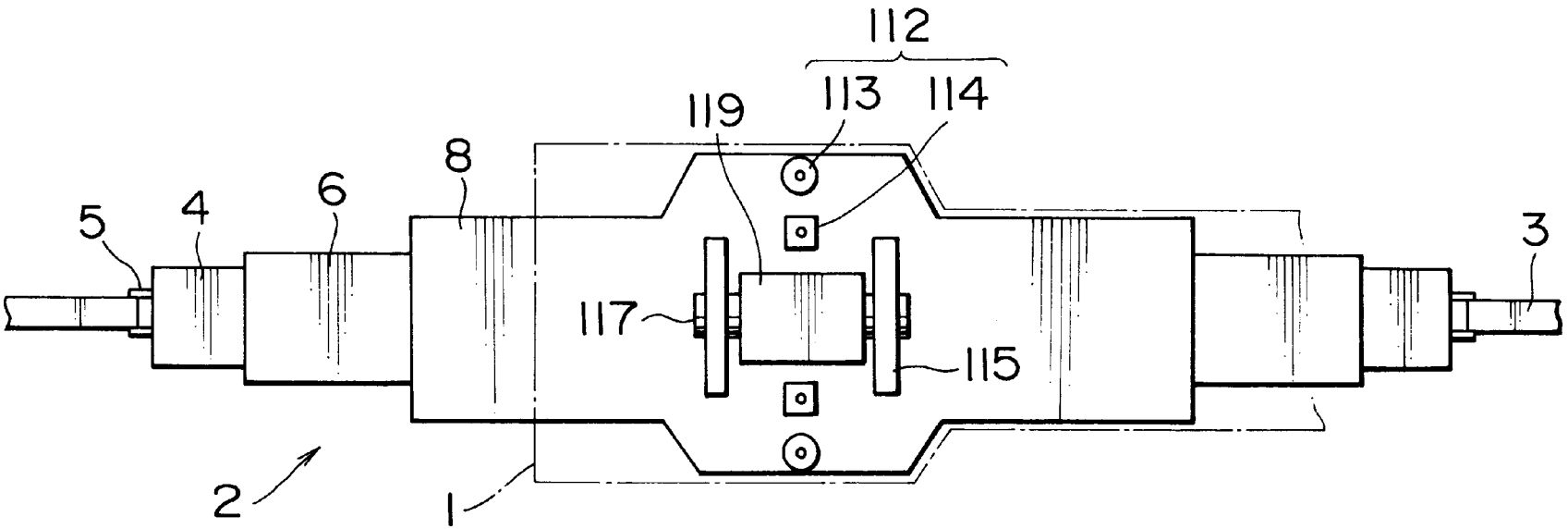
FIG. 13 is a sectional view taken in the direction of the arrows along the line XIII—XIII of FIG. 11.

As shown in FIGS. 11 to 13, the seismic isolation system 10 has a universal joint mechanism 111 for connecting the lower portion of the crane body 1 to the center of the upper equalizer beam 8 at the upper part of the traveling means 2, and also has compression springs 113 and hydraulic dampers 114, which serve as a vibration damping mechanism 112 which connects the crane body 1 to the traveling means 2 at positions on both sides of the universal joint mechanism 111. As the vibration damping mechanism 112, an elastic rubber type mechanism or a hydraulic cylinder type mechanism is alternatively used, and a mechanism of any type can be used.

The universal joint mechanism 111 has saddles 115 projecting downward from the lower part of the crane body 1, and a universal joint block 119 whose upper part is pivotally mounted to the saddles 115 via a shaft 117 disposed in the travel direction. The universal joint mechanism also has a lower pivotally mounting portion for pivotally mounting the lower part of the block 119 to a bearing 116 on the traveling means 2 via a horizontal transverse shaft 118.

The configuration may be such that the shaft 117 is replaced with a horizontal transverse shaft, and the horizontal transverse shaft 118 is replaced with a shaft disposed in the travel direction.

On the above-described crane equipped with the seismic isolation system 10, the vibration damping mechanisms 112 provided on both sides of the universal joint mechanism 111 are balanced mutually to keep the universal joint block 119 vertical at the normal time. In this state, the weight of the crane is transmitted as the axial load A from the four corners of the crane body 1 to the traveling means 2 through the universal joint mechanism 111.

The axial load A, the overturning moment load M, and the radial load R, which are applied to the crane body 1 in operation by seismic vibrations, are also transmitted similarly to between the traveling means 2 and the crane body 1 through the universal joint mechanism 111.

At this time, the excitation forces of the radial load R and the axial load A applied to the crane in the transverse direction perpendicular to the rail 3 by seismic vibrations are absorbed as vibrations with a long vibration period by the motion of the universal joint block 119 which turns around the shaft 117 parallel with the travel direction while being damped by the elastic resistance of the compression springs 113 and the hydraulic dampers 114, which serve as the vertical vibration damping mechanism 112, on the traveling means 2.

At this time, the transverse relative displacement between the traveling means 2 and the crane body 1 is given by the inclination of the crane body 1 with the shaft 117 of the universal joint mechanism 111 being the center, and the absorption of displacement and the holding of the position are given by the vertical extension and contraction of the compression springs 113 and the hydraulic dampers 114 of the vibration damping mechanism 112.

Therefore, for vibrations with a long natural period of portal crane caused by an earthquake, the seismic vibrations can be absorbed and damped safely by a large displacement of the seismic isolation system 10.

As shown in FIGS. 17 and 18, when a torsional load S is applied by different radial loads R applied to the traveling means 2 at four corners of the crane body 1, the above-described operation takes place independently at each portion of the traveling means 2, so that the seismic isolation system 10 operates longitudinally and transversely with different displacement for each portion of the traveling means 2, by which the torsional load S can be absorbed safely on each traveling means 2.

Further, by arranging the springs and dampers at longitudinally symmetrical positions with respect to the universal joint mechanism 111, the same effect can be achieved for the seismic vibrations in the travel direction.

Also, according to the seismic isolation system of this construction, the hydraulic damper 114 is configured so as to be controllable, by which seismic vibrations can be damped actively.

Further, this configuration can provide a seismic isolation mechanism that can safely absorb a great horizontal swing torsion of a large portal crane body 1 by using a compact mechanism.

Also, since the seismic isolation system 10 consists of an independent mechanism disposed between the traveling means 2 and the crane body 1, maintenance, adjustment, and repair work can be done easily.

Figure 14:
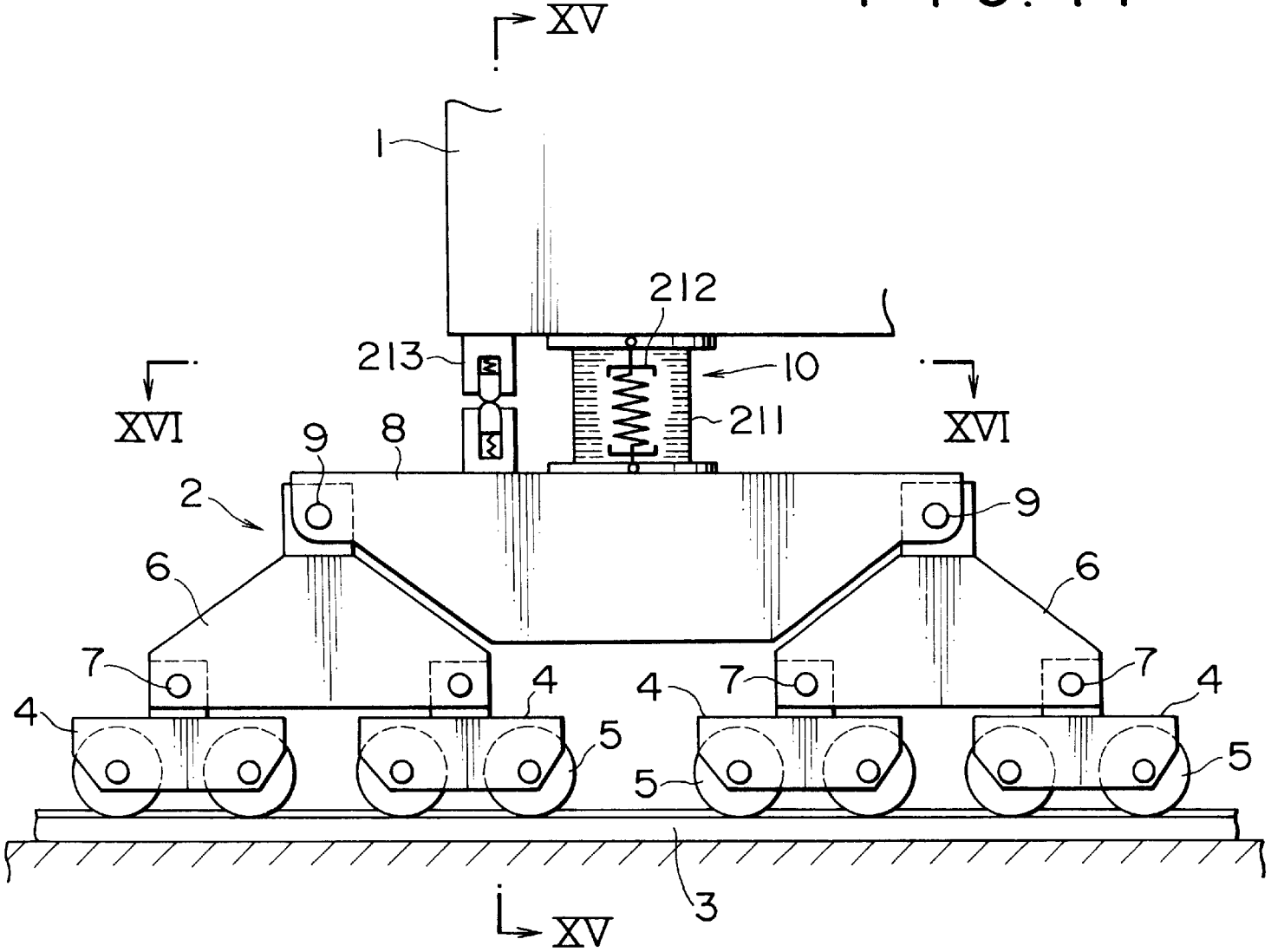
FIG. 14 is a side view of a seismic isolation system for a crane in accordance with a fourth embodiment of the present invention.

Next, a seismic isolation system for a crane in accordance with a fourth embodiment of the present invention will be described. FIG. 14 is a side view of the seismic isolation system, FIG. 15 is a sectional view taken in the direction of the arrows along the line XV—XV of FIG. 14, and FIG. 16 is a sectional view taken in the direction of the arrows along the line XVI—XVI of FIG. 14.

In this fourth embodiment as well, as shown in FIG. 14, like the above-described embodiments, traveling means 2 is provided at each of four corners of the crane body 1 of a portal crane. Specifically, as shown in FIG. 14, the traveling means 2 comprises four sets of tracks 4 each provided with two wheels 5 which travel on a rail 3, two sets of lower equalizer beams 6 each of which connects the adjacent two sets of tracks 4, 4 by using shafts 7, and an upper equalizer beam 8 which connects two sets of lower equalizer beams 6 by using shafts 9, and a seismic isolation system 10 of this embodiment is mounted between the upper equalizer beam 8 and the crane body 1.

Figure 15:
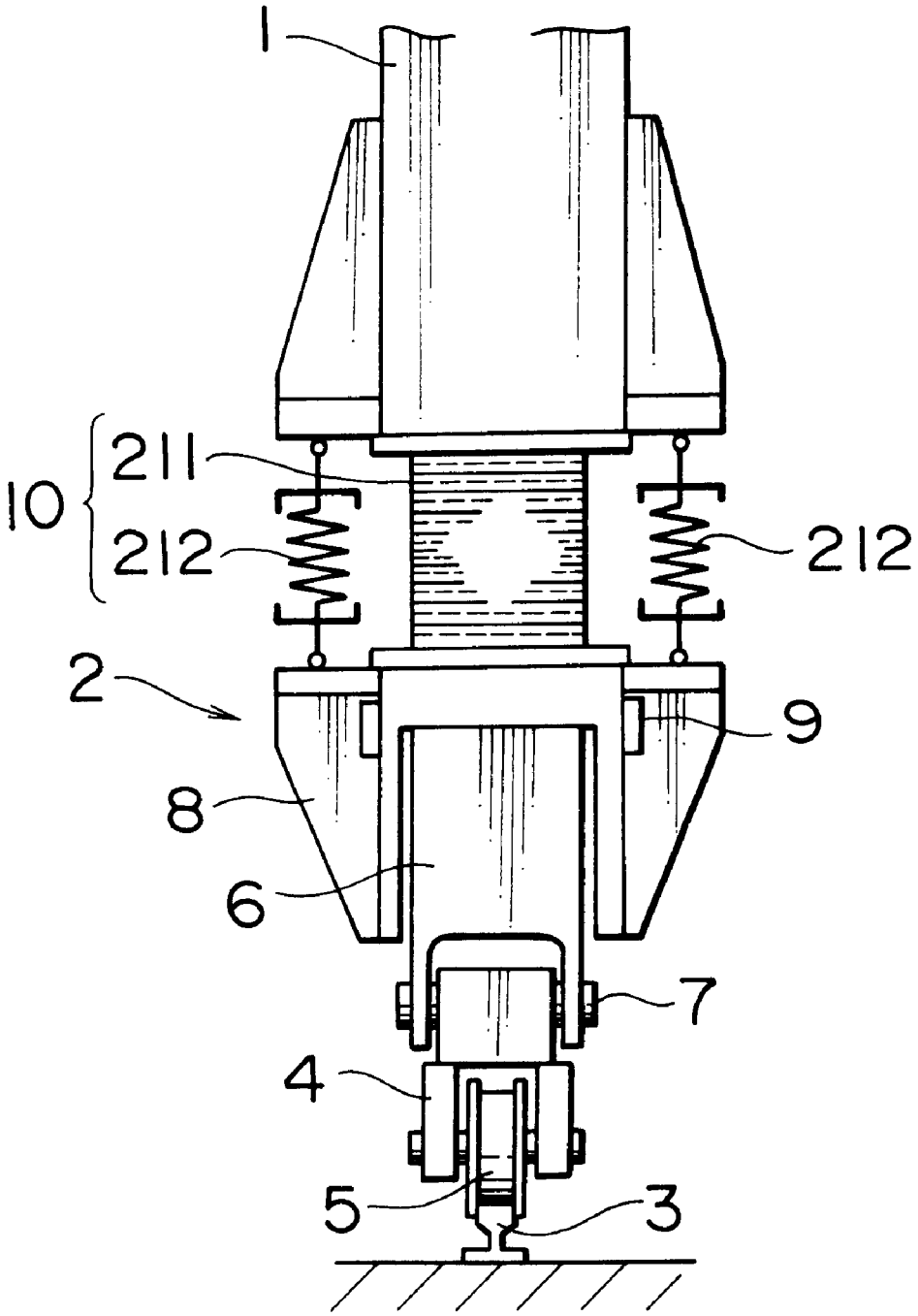
FIG. 15 is a sectional view taken in the direction of the arrows along the line XV—XV of FIG. 14.
Figure 16:
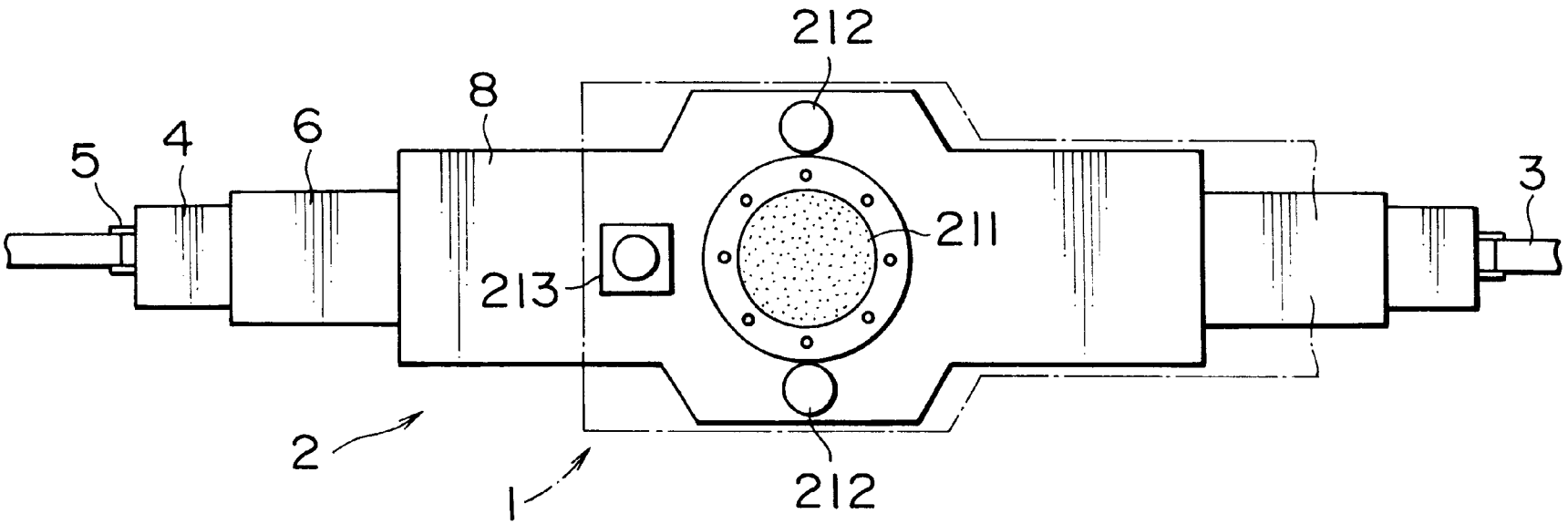
FIG. 16 is a sectional view taken in the direction of the arrows along the line XVI—XVI of FIG. 14.

As shown in FIGS. 14 to 16, the seismic isolation system 10 is composed of a laminated rubber 211 mounted between the lower face of the crane body 1 and the central portion of the traveling means 2 (the central portion of the upper equalizer beam 8), and compression springs 212 serving as a turnover preventive restraining member which are interposed between the lower face of the crane body 1 and the upper face of the upper equalizer beam 8 at positions on both sides of the laminated rubber 211.

Also, a trigger mechanism 213 for restraining the horizontal relative displacement between the crane body 1 and the traveling means 2 is provided between the crane body 1 and the traveling means 2.

As the trigger mechanism 213, a shear pin type, a holding brake type, or a wedge-pin type can be used. Further, a cam roller type, which is released and driven by an earthquake detecting sensor, can also be used.

As the laminated rubber 211, a laminated rubber, which has a height and diameter enough to accommodate a transverse displacement occurring between the crane body 1 and the traveling means 2 when seismic vibrations occur, is used.

On the above-described crane equipped with the seismic isolation system 10, the horizontal force is kept by the trigger mechanism 213 and the compression springs provided on both sides of the laminated rubber 211 are balanced mutually at the normal time, by which the laminated rubber 211 is kept transversely neutral.

In this state, the weight of the crane is transmitted as the axial load A from the four corners of the portal crane body 1 to the traveling means 2 through the laminated rubber 211 and the compression springs 212.

The excitation forces of the axial load A, the overturning moment load M, and the radial load R, which are newly applied to the portal crane in operation by seismic vibrations, are also transmitted similarly to between the traveling means 2 and the crane body 1 through the compression springs 212 on both sides of the laminated rubber 211.

When a transverse excitation force exceeding a given value is applied to the portal crane by an earthquake, the trigger mechanism 213 is released, and a transverse relative displacement caused between the crane body 1 and the traveling means 2 by the radial load R is absorbed by the spring element and the friction damping due to the deformation of the laminated rubber 211. At the same time, the overturning moment load M applied along with the transverse radial load R is supported by the resisting force of the compression springs 212 on both sides, and the restoring operation to the deflection zero position is performed by the restoring force of the laminated rubber 211 and the compression springs 212.

When an excitation force in the travel direction is applied to the crane by an earthquake, the relative displacement in the travel direction occurring between the crane body 1 and the traveling means 2 is absorbed by the slip between the traveling means 2 and the rail 3, the deflection in the travel direction of the laminated rubber 211, and the restoring force, so that the deflection zero position is restored.

Therefore, vibrations with a long period occurring on the portal crane can be absorbed and damped safely by a large displacement of the laminated rubber 211 and the compression springs 212.

Since the above-described operation takes place independently at each portion of the traveling means 2 at four corners of the portal crane body 1, the seismic force acting on the portal crane can be absorbed safely on each traveling means 2. When a torsional load S is applied to the crane body 1 by the application of different radial loads R, the above-described operation takes place independently at each portion of the traveling means 2, so that the laminated rubber 211 and the compression springs 212 operate longitudinally and transversely with different displacement for each portion of the traveling means 2, by which the torsional load S can be absorbed safely on each traveling means 2.

In the seismic isolation system thus configured, by additionally providing a hydraulic damper in the travel direction or transverse direction between the crane body 1 and the traveling means 2, the vibration damping effect can further be enhanced.

Further, this configuration can provide a seismic isolation mechanism that can safely absorb a great horizontal swing torsion of a large portal crane body 1 by using a compact mechanism.

Also, since the seismic isolation system 10 consists of an independent simple mechanism disposed between the traveling means 2 and the crane body 1, maintenance, adjustment, and repair work can be done easily.

As turnover preventive restraining members arranged on both sides of the laminated rubber 211, link type members can be used in place of the compression springs 212. Specifically, a link mechanism can be used in which the lower end of a link is pivotally supported on the upper equalizer member 8 by a longitudinal pin, and the upper end thereof is pivotally supported by a longitudinal pin in a convex arcuate guide hole formed at the upper part of a bracket installed along the transverse direction on the lower face of the crane body 1.

Figure 19:
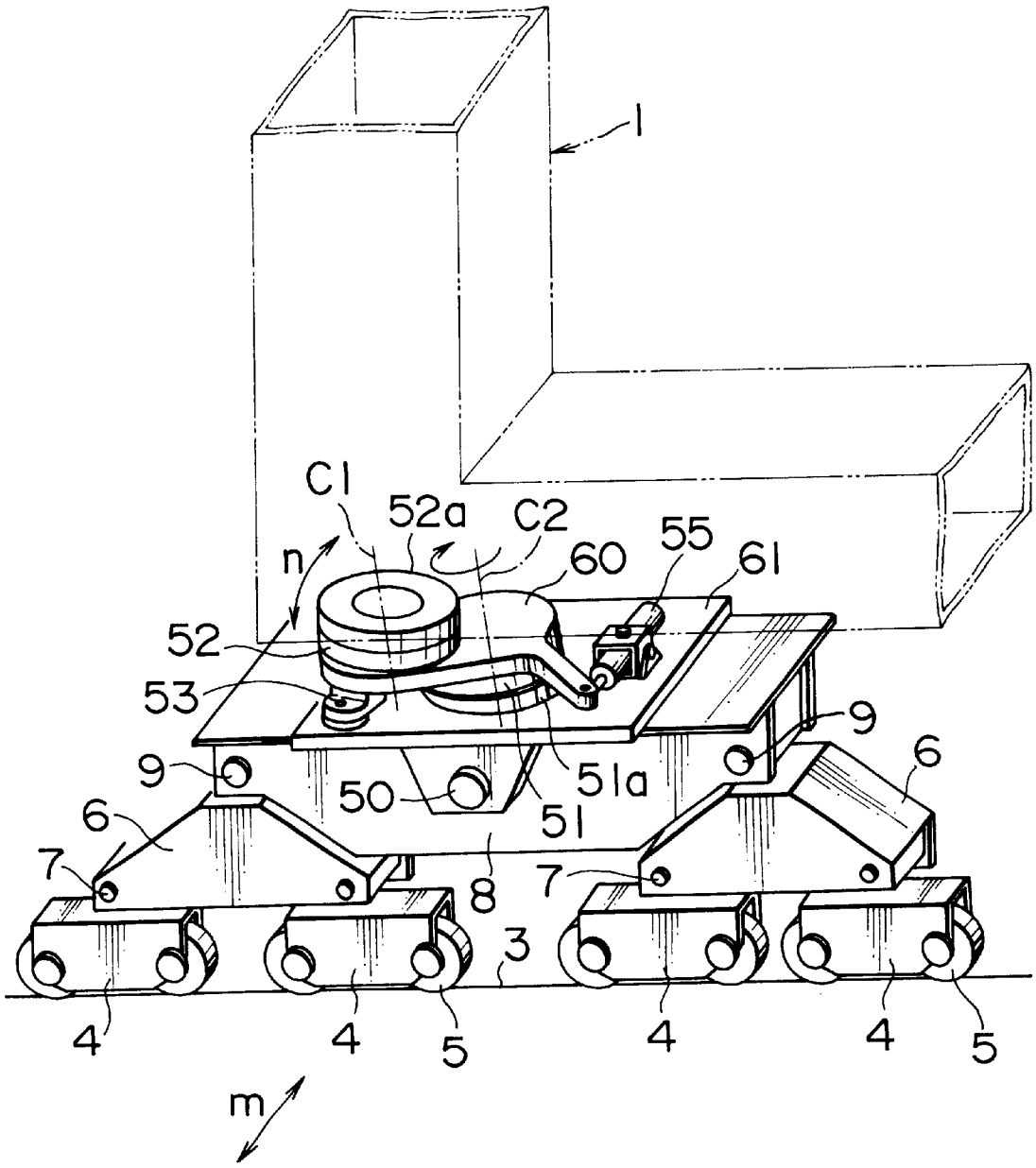
FIG. 19 is a perspective view of a seismic isolation system for a crane in accordance with a fifth embodiment of the present invention.

Next, a seismic isolation system for a crane in accordance with a fifth embodiment of the present invention will be described. FIG. 19 is a perspective view showing a schematic construction of the seismic isolation system, FIG. 20 is a side view of the seismic isolation system, FIG. 21 is a view taken in the direction of the arrows along the line A—A of FIG. 20, and FIG. 22 is a side view showing a modification of an essential portion of the seismic isolation system.

Figure 20:
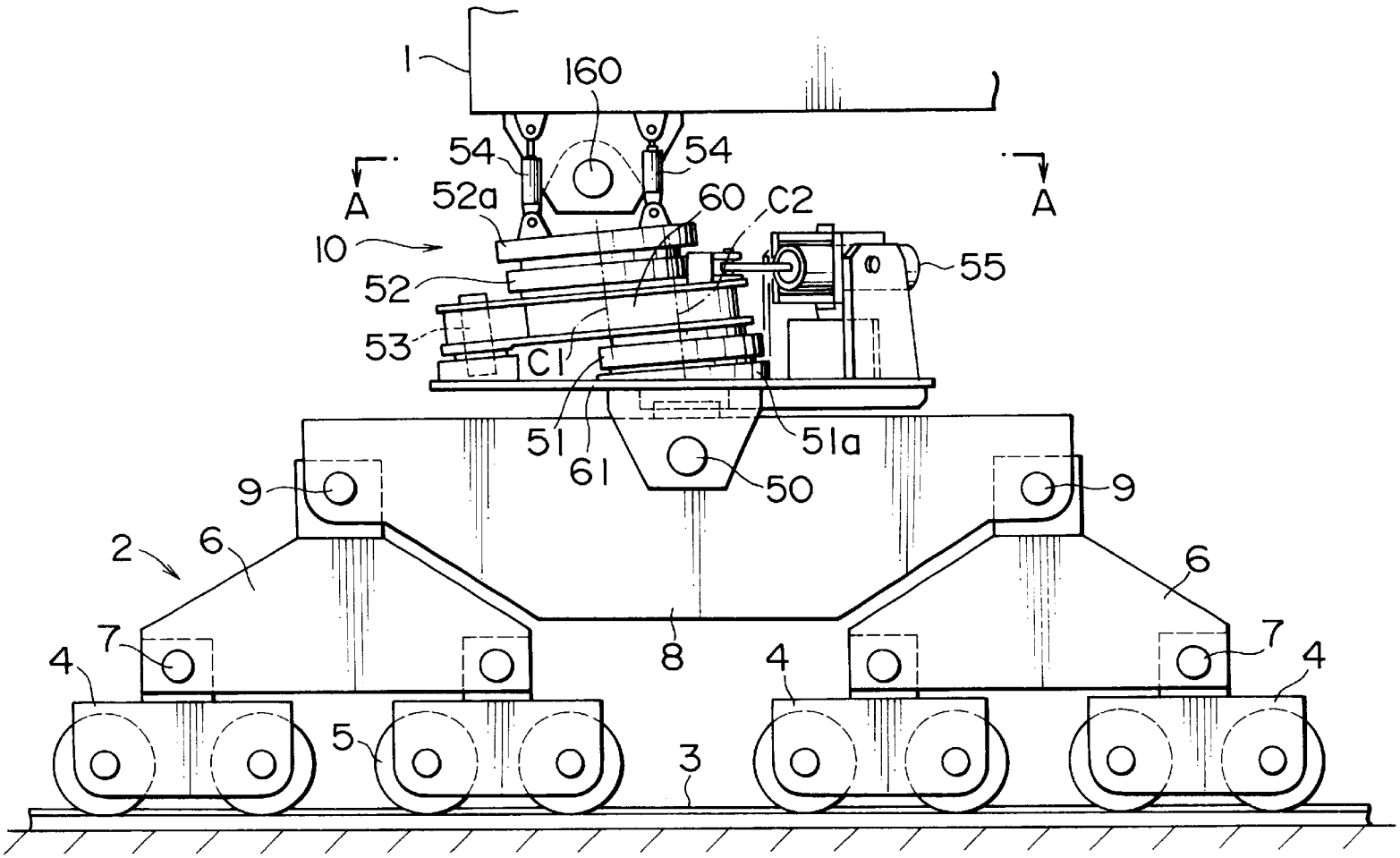
FIG. 20 is a side view of the seismic isolation system for a crane shown in FIG. 19.
Figure 21:
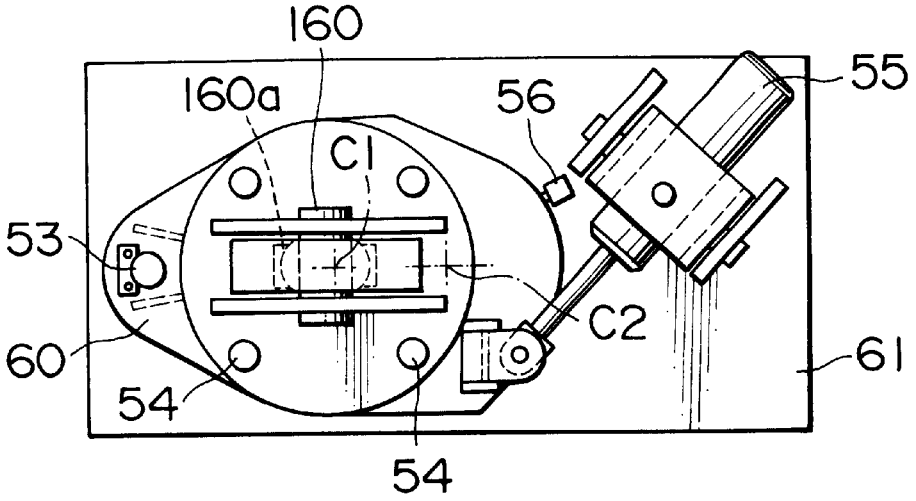
FIG. 21 is a view taken in the direction of the arrows along the line A—A of FIG. 20.
Figure 22:
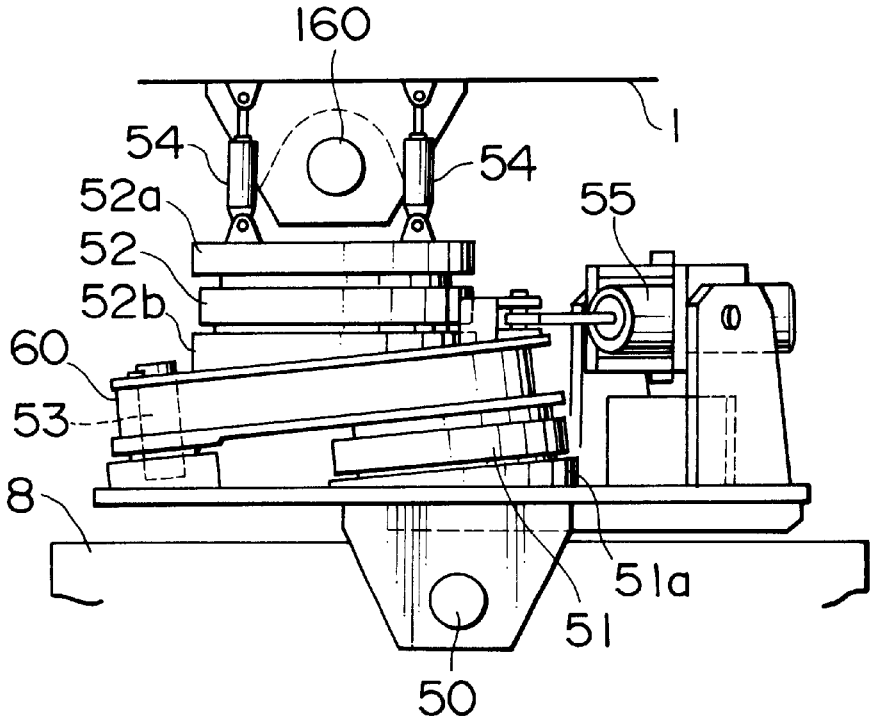
FIG. 22 is a side view showing a modification of the seismic isolation system for a crane shown in FIG. 20.

The crane equipped with the seismic isolation system of this embodiment is also constructed as a portal crane as shown in FIGS. 17 and 18, and a seismic isolation system 10 is provided between a portal crane body 1 and traveling means 2 provided at four corners thereof as shown in FIGS. 20 and 21.

Specifically, as shown in FIG. 20, the traveling means 2 comprises four sets of tracks 4 each provided with two wheels 5 which travel on a rail 3, two sets of lower equalizer beams 6 each of which connects the adjacent two sets of tracks 4, 4 by using shafts 7, and an upper equalizer beam 8 which connects two sets of lower equalizer beams 6, 6 by using shafts 9, and the seismic isolation system 10 in accordance with the fifth embodiment is mounted between the upper equalizer beam 8 and the crane body 1.

In this embodiment, a first swing bearing ring 51 is provided, via a base member 51*a* having an inclined support face, on a bed member 61 pivotally mounted at the center of the upper equalizer beam 8 by using a transverse shaft 50 so as to be inclined downward in the travel direction.

The first swing bearing ring 51 has a construction similar to that of the swing bearing ring 12 shown in FIG. 4. Specifically, a lower ring of the first swing bearing ring 51 is fixed to the base member 51*a*, and an upper ring thereof is fixed to an inclined beam 60.

The rotation centerline C2 of the upper ring and the lower ring of the first swing bearing ring 51, which can be rotated relatively, is inclined, and a second swing bearing ring 52 having the same construction as that of the first swing bearing ring 51 is provided on the upper face of the inclined beam 60, whose rotation centerline C1 is shifted horizontally from the rotation centerline C2. Specifically, a lower ring of the second swing bearing ring 52 is fixed to the upper face of the inclined beam 60, and an upper ring thereof is fixed to amounting plate 52*a*.

A hinge pin type connecting member 160 including a spherical bearing 160*a* and a plurality of hydraulic cylinders 54 are provided as a crane body connecting portion for connecting the upper ring of the second swing bearing ring 52 to the lower part of the crane body 1 via the mounting plate 52*a*.

Each of the hydraulic cylinders 54 is adapted to absorb a change in face angle caused when the inclined beam 60 rotates around the rotation centerline C2 by being extended and contracted in response to a detection signal sent from an inclined beam rotational angle detecting sensor 56.

Also, the hydraulic cylinder 54 supports the moment load in the transverse direction and the travel direction, and transfers the moment load between the crane body 1 and the traveling means 2.

A shear pin 53 is provided between the inclined beam 60 and the bed member 61 as a restraining mechanism. A steady relative positional relationship between the crane body 1 and the traveling means 2 is kept by the shear pin 53 at the normal time. When an earthquake occurs, however, the steady relationship is broken off by the cutting of the shear pin 53 caused by the seismic force, so that a relative movement of the crane body 1 and the traveling means 2 is allowed, by which the function of the seismic isolation system 10 is fulfilled as described later.

Also, an oil damper 55 is mounted between the inclined beam 60 and the bed member 61 to absorb kinetic energy while regulating the relative movement of the crane body 1 and the traveling means 2 when the seismic isolation system 10 is operating.

In the seismic isolation system of the above-described embodiment, the load of the crane body 1 is supported through the first swing bearing ring 51 on the side of the traveling means 2, the inclined beam 60 at the middle part, and the second swing bearing ring 52 on the side of the crane body 1, and further through the hinge pin type connecting member 160 and the hydraulic cylinders 54, serving as the crane body connecting portion.

When the shear pin 53 is cut at the time of the occurrence of an earthquake, and the traveling means 2 moves in the transverse direction as indicated by an arrow mark m in FIG. 19 together with the rail 3, since the first swing bearing ring 51 and the second swing bearing ring 52 have the mutually shifted respective rotation centerlines, the crane body 1 attempts to remain by the inertia force and shifts transversely relative to the traveling means 2. Accordingly, the inclined beam 60 is swung around the rotation centerline C2 as indicated by an arrow mark n in FIG. 19, and pushes up the crane body 1 in cooperation with the second swing bearing ring 52 on the beam 60. Thus, the crane body 1 mainly moves vertically along with the reciprocating transverse movement of the traveling means 2 caused by an earthquake, so that a restoring force due to the gravity acts, by which the period of the crane body 1 is made long.

Since the upper ring of the second swing bearing ring 52 and the crane body 1 are connected to each other by the hinge pin type connecting member 160 and hydraulic cylinders 54 so that the inclination can be regulated, the crane body 1 can be kept horizontal by adjusting the hydraulic cylinders 54 according to the face angle of the inclined beam 60, so that the relative relationship of the crane body 1 with respect to the second swing bearing ring 52 can be established properly.

Further, since the restraining mechanism as the shear pin (or the brake) 53 is provided between the inclined beam 60 and the traveling means 2, and the restraining mechanism is released only when an earthquake occurs, a stable operation is performed as in the case of the conventional crane equipment. When the restraining mechanism is released by the seismic force and the inclined beam 60 is turned reciprocatively, since the oil damper 55 is provided to absorb kinetic energy while restraining the turning of the inclined beam 60, the seismic energy is absorbed while the relative movement of the crane body 1 and the traveling means 2 is relaxed properly.

In a modification of the fifth embodiment shown in FIG. 22, the second swing bearing ring 52 is kept horizontal by being mounted via a base member 52*b* whose bottom face is inclined with respect to the inclined beam 60, but other constructions are the same as those of the system shown in FIG. 20, and almost the same operation and effects as those of the system of the fifth embodiment can be achieved.

Figure 23:
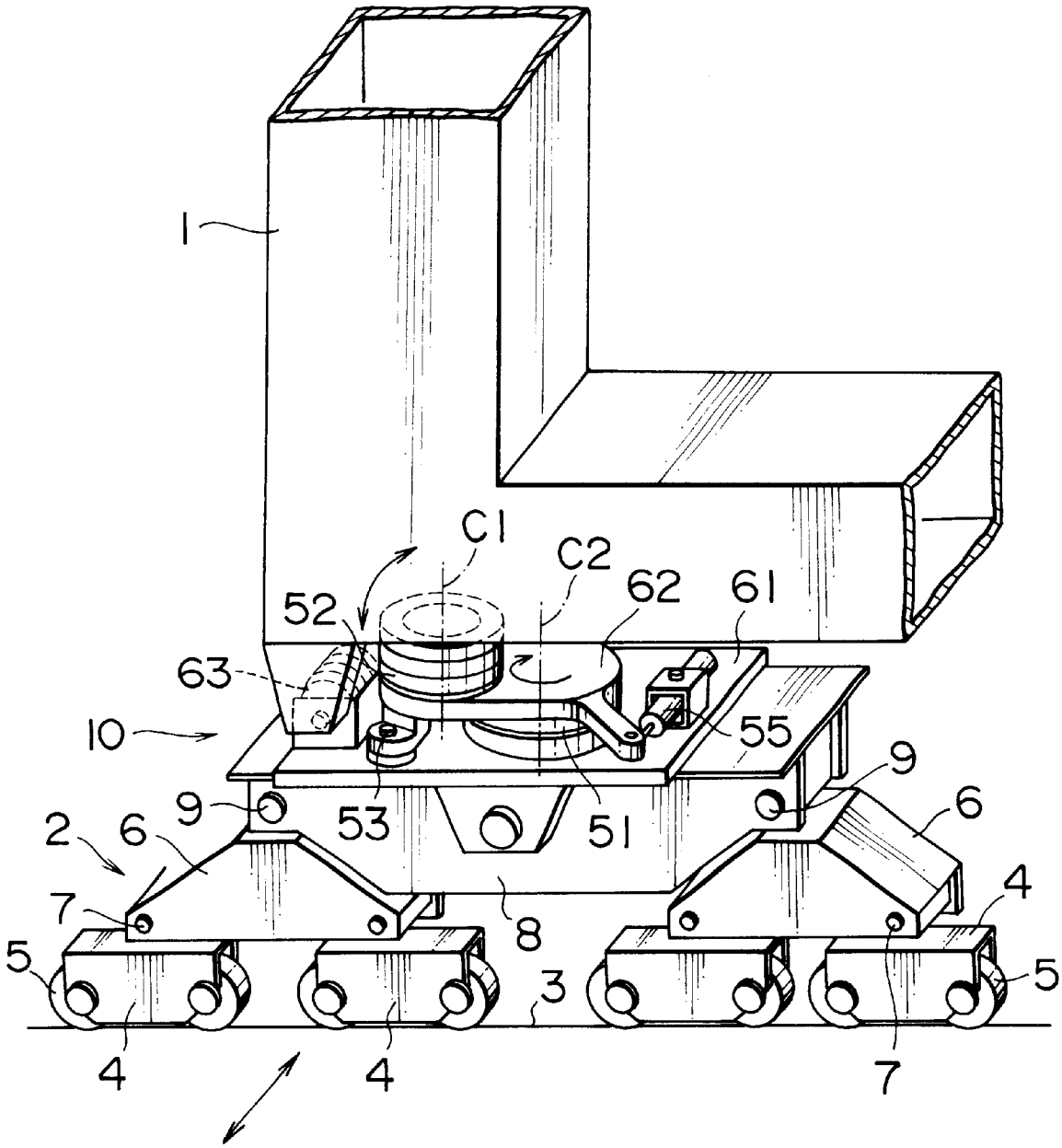
FIG. 23 is a perspective view of a seismic isolation system for a crane in accordance with a sixth embodiment of the present invention.
Figure 24:
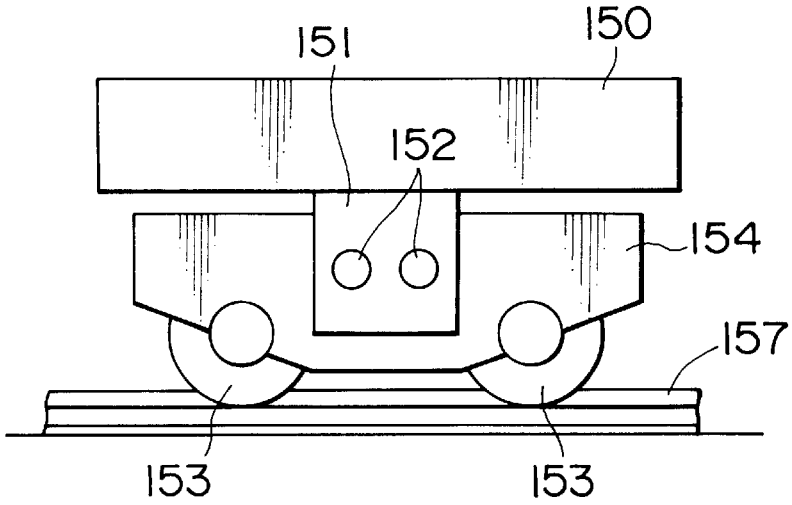
FIG. 24 RELATED ART
FIG. 24 is a side view of a conventional overhead traveling crane.
Figure 25:
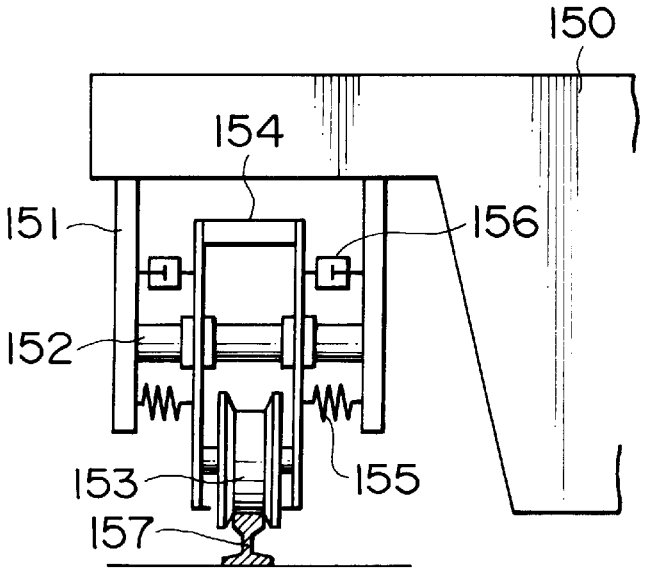
FIG. 25 RELATED ART
FIG. 25 is an enlarged front view of an essential portion of the crane shown in FIG. 24.

Next, a seismic isolation system for a crane in accordance with a sixth embodiment of the present invention will be described. FIG. 23 is a perspective view showing an essential portion of the seismic isolation system. The crane equipped with the seismic isolation system of this embodiment is also constructed as a portal crane as shown in FIGS. 17 and 18, and a seismic isolation system 10 is provided between a portal crane body 1 and traveling means 2 provided at four corners thereof as shown in FIG. 23.

Specifically, as shown in FIG. 23, the traveling means 2 comprises four sets of tracks 4 each provided with two wheels 5 which travel on a rail 3, two sets of lower equalizer beams 6 each of which connects the adjacent two sets of tracks 4, 4 by using shafts 7, and an upper equalizer beam 8 which connects two sets of lower equalizer beams 6, 6 by using shafts 9, and the seismic isolation system 10 in accordance with the sixth embodiment is mounted between the upper equalizer beam 8 and the crane body 1.

In this embodiment, a first swing bearing ring 51 is provided in a horizontal state on a bed member 61 pivotally mounted at the center of the upper equalizer beam 8 by using a transverse shaft 50.

The first swing bearing ring 51 has a construction similar to that of the swing bearing ring 12 shown in FIG. 4. Specifically, a lower ring of the first swing bearing ring 51 is fixed to a bed member 61, and an upper ring thereof is fixed to a horizontal beam 62.

The rotation centerline C2 of the upper ring and the lower ring of the first swing bearing ring 51, which can be rotated relatively, is vertical, and a second swing bearing ring 52 having the same construction as that of the first swing bearing ring 51 is provided on the upper face of the horizontal beam 62, whose rotation centerline C1 is shifted horizontally from the rotation centerline C2. Specifically, a lower ring of the second swing bearing ring 52 is fixed to the upper face of the horizontal beam 62, and an upper ring thereof is fixed to a mounting plate 52*a*.

An appropriate crane body connecting portion, such as bolts and nuts, is provided to connect the upper ring of the second swing bearing ring 52 to the lower part of the crane body 1 via the mounting plate 52*a*.

A shear pin (or a brake) 53 is provided between the horizontal beam 62 and the bed member 61 as a restraining mechanism. A steady relative positional relationship between the crane body 1 and the traveling means 2 is kept by the shear pin 53 at the normal time. When an earthquake occurs, however, the steady relationship is broken off by the cutting of the shear pin 53 caused by the seismic force, so that the relative movement of the crane body 1 and the traveling means 2 is allowed, by which the function of the seismic isolation system 10 is fulfilled as described later.

Also, an oil damper 55 is mounted between the horizontal beam 62 and the bed member 61 to absorb kinetic energy while regulating the relative movement of the crane body 1 and the traveling means 2 when the seismic isolation system 10 is operating.

Thus, the movable connecting mechanism composed of the first swing bearing ring 51, the horizontal beam 62, the second swing bearing ring 52, the bolts and nuts serving as the crane body connecting portion, and the like is provided between the crane body 1 and the traveling means 2 to connect the crane body 1 to the traveling means 2 while allowing the relative displacement of the crane body 1, which attempts to remain at the original position by the inertia force acting on the crane body 1, with respect to the traveling means 2. Particularly, in the sixth embodiment, a spring mechanism (coil spring) 63 is mounted between the crane body 1 and the bed member 61 to elastically keep the steady positional relationship between the crane body 1 and the traveling means 2.

In the above-described sixth embodiment, in the movable connecting mechanism for connecting the crane body 1 to the traveling means 2, the horizontal beam 62 is provided in place of the inclined beam 60 in the fifth embodiment described before. Therefore, the relative movement caused between the traveling means 2 and the crane body 1 by the cooperative action of the horizontal beam 62 and the first and second swing bearing rings 51 and 52 below and above the horizontal beam 62 when an earthquake occurs is effected only in the horizontal plane. The steady positional relationship between the traveling means 2 and the crane body 1 is kept by the spring mechanism 63, and the relative movement of the crane body 1 and the traveling means 2, which is effected via the spring mechanism 63 when an earthquake occurs, is relaxed by the oil damper 55. Thus, the seismic isolation function for the crane body 1 is fulfilled properly while the seismic energy is absorbed.

In this embodiment as well, the load of the crane body 1 is supported without a difficulty through the first swing bearing ring 51 on the side of the traveling means 2, the horizontal beam 62 at the middle part, and the second swing bearing ring 52 on the side of the crane body 1, and further through the crane body connecting portion.

Further, since the restraining mechanism such as the shear pin (or the brake) 53 is provided between the horizontal beam 62 and the traveling means 2, and the restraining mechanism is released only when an earthquake occurs, the horizontal beam 62 is fixed at the normal time, so that a stable operation is formed as in the case of the conventional crane equipment.

What is claimed is:

1. A seismic isolation system for a crane adapted to be provided between a crane body and a movable support having a plurality of wheels for moving said crane body along a rail, comprising:

a bearing structure adapted to be connected between said crane body and said movable support and adapted to allow relative movement of said crane body and said movable support while maintaining said crane body and said movable support in a connected relationship when said crane is subjected to seismic force;

a seismic force responsive releasable connector adapted to maintain a predetermined fixed positional relationship between said crane body and said movable support when said connector is in a connected state and allowing a relative movement of said crane body and said movable support when said connector is released in response to a seismic force;

an energy absorbing damper adapted to be operatively associated with said crane body and said movable support and being adapted to restrain an increase in relative movement of said crane body and said movable support when said crane is subjected to seismic force; and a restoring positioner adapted to be connected between said crane body and said movable support and adapted to restore the positional relationship between said crane body and said movable support to said predetermined fixed relationship.

2. A seismic isolation system for a crane, adapted to be provided between a crane body and a movable support having a plurality of wheels for moving said crane body along a rail comprising:

a pivot bearing ring comprising a lower ring adapted to be fixedly connected in a horizontal orientation to said movable support, and an upper ring concentrically engaged with said lower ring to allow relative rotation with respect to said lower ring, and further comprising a vertical shaft supporting pivot bearing support connected to said upper ring at an eccentric position thereon;

a crane load supporting block having a vertical shaft pivotably supported by said pivot bearing support;

saddles adapted to be connected to a lower part of said crane body and pivotably supporting said block for rotation about a horizontal transverse shaft;

a horizontal lever, having a proximal end pivotably supported on the upper ring of said pivot bearing ring by said horizontal transverse shaft; and a lever restoring positioner adapted to restore said horizontal lever to a predetermined neutral position from a moved position and supporting the distal end of said horizontal lever for rotation around a vertical center line of said pivot bearing ring.

3. A seismic isolation system for a crane according to claim 2 wherein said lever restoring positioner comprises a roller positioned at the distal end of said horizontal lever and a cam configured guide rail adapted to be provided on said movable support and adapted to receive said roller thereon, said cam configured surface being inclined downwardly towards a middle position on said rail, said middle position defining said neutral position.

4. A seismic isolation system for a crane according to claim 3 comprising a breaking force applying structure adapted to apply a breaking force against rotational motion of said horizontal lever and being adapted to be fixedly connected to said movable support.

5. A seismic isolation system for a crane according to claim 4 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

6. A seismic isolation system for a crane according to claim 3 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

7. A seismic isolation system for a crane according to claim 3 further comprising a damper adapted to restrain rotational motion of said horizontal lever and being adapted to be mounted between said movable support and said horizontal lever.

8. A seismic isolation system for a crane according to claim 7 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

9. A seismic isolation system for a crane according to claim 2 wherein said lever restoring positioner comprises a laminated rubber bearing adapted to be mounted between a lower face of said horizontal lever and an upper face of said movable support.

10. A seismic isolation system for a crane according to claim 9 comprising a breaking force applying structure adapted to apply a breaking force against rotational motion of said horizontal lever and being adapted to be fixedly connected to said movable support.

11. A seismic isolation system for a crane according to claim 10 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

12. A seismic isolation system for a crane according to claim 9 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

13. A seismic isolation system for a crane according to claim 9 further comprising a damper adapted to restrain rotational motion of said horizontal lever and being adapted to be mounted between said mavable support and said harizontal lever.

14. A seismic isolation system for a crane according to claim 13 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

15. A seismic isolation system for a crane according to claim 2 wherein said lever restoring positioner comprises a coil spring adapted to be mounted between a lower face of said horizontal lever and an upper face of said movable support, and a guide member adapted to be positioned between said horizontal lever and said movable support and being adapted to guide the distal end of said horizontal lever along a circumferential path on an upper face of said movable support.

16. A seismic isolation system for a crane according to claim 15 comprising a breaking force applying structure adapted to apply a breaking force against rotational motion of said horizontal lever and being adapted to be fixedly connected to said movable support.

17. A seismic isolation system for a crane according to claim 16 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

18. A seismic isolation system for a crane according to claim 15 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

19. A seismic isolation system for a crane according to claim 15 further comprising a damper adapted to restrain rotational motion of said horizontal lever and being adapted to be mounted between said movable support and said horizontal lever.

20. A seismic isolation system for a crane according to claim 19 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

21. A seismic isolation system for a crane according to claim 2 comprising a breaking force applying structure adapted to apply a breaking force against rotational motion of said horizontal lever and being adapted to be fixedly connected to said movable support.

22. A seismic isolation system for a crane according to claim 21 further comprising a damper adapted to restrain rotational motion of said horizontal lever and being adapted to be mounted between said movable support and said horizontal lever.

23. A seismic isolation system for a crane according to claim 22 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

24. A seismic isolation system for a crane according to claim 21 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

25. A seismic isolation system for a crane according to claim 2 further comprising a damper adapted to restrain rotational motion of said horizontal lever and being adapted to be mounted between said movable support and said horizontal lever.

26. A seismic isolation system for a crane according to claim 25 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

27. A seismic isolation system for a crane according to claim 2 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

28. A seismic isolation system for a crane, adapted to be provided between a crane body and a movable support having a plurality of wheels for moving said crane body along a rail, comprising:

a laminated rubber bearing adapted to be mounted between a lower face of said crane body and a central portion of said movable support; and first and second transverse supports adapted to be mounted between the lower face of said crane body and an upper face of said movable support at longitudinally symmetrical positions, respectively, with respect to said laminated rubber bearing, said transverse supports being constructed and adapted to allow relative transverse movement between said movable support and said crane body.

29. A seismic isolation system for a crane according to claim 28 further comprising a damper adapted to restrain said transverse relative movement between said crane body and said movable support and adapted to be mounted between said crane body and said movable support.

30. A seismic isolation system for a crane according to claim 29 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

31. A seismic isolation system for a crane according to claim 28 additionally comprising a vibration detecting sensor for detecting vibration of said crane body or said movable support in response to seismic force, a vibration control adapted to send a control signal for restraining vibrations of said crane body in response to a detection signal from said sensor, and an active damper connected to said control to receive said control signals therefrom and being adapted to be operatively coupled between said movable support and said crane body to restrain vibrations of said crane body in response to said control signals.

32. A seismic isolation system for a crane adapted to be provided between a crane body and a movable support having a plurality of wheels for moving said crane body along a rail, and comprising:

a universal joint bearing adapted to be connected between a lower portion of said crane body and an upper center portion of said movable support; and first and second vibration dampers adapted to be operatively connected between said crane body and said movable support, said first and second vibration dampers being positioned on opposing sides of said universal joint bearing.

33. A seismic isolation system according to claim 32 wherein said first and second vibration dampers are positioned at longitudinally symmetrical positions with respect to said universal joint bearing.

34. A seismic isolation system for a crane according to claim 33 wherein said universal joint bearing comprises saddles projecting downwardly from a lower part of said crane body, a universal joint block having an upper portion pivotably mounted to said saddles via a shaft oriented in the direction of said rail, said universal joint block further comprising a lower portion pivotably mounted to a bearing on said movable support via a horizontal transverse shaft.

35. A seismic isolation system for a crane according to claim 32 wherein said universal joint bearing comprises saddles projecting downwardly from a lower part of said crane body, a universal joint block having an upper portion pivotably mounted to said saddles via a shaft oriented in the direction of said rail, said universal joint block further comprising a lower portion pivotably mounted to a bearing on said movable support via a horizontal transverse shaft.

36. A seismic isolation system for a crane adapted to be provided between a crane body and a movable support having a plurality of wheels for moving said crane body along a rail, comprising:

a laminated rubber bearing adapted to be mounted between a lower face of said crane body and a central portion of said movable support; and first and second turnover restraining members each of said members being adapted to be coupled between the lower face of said crane body and an upper face of said movable support and said members being positioned on opposing sides of said laminated rubber bearing.

37. A seismic isolation system for a crane according to claim 36 comprising a releasable connector adapted maintain a predetermined fixed relative horizontal relationship between said crane body and said movable support when said connector is connected between said crane body and said movable support, said releasable connector being adapted to release the connection between said crane body and said movable support in response to a predetermined seismic force to thereby allow relative horizontal movement between said crane body and said movable support.

38. A seismic isolation system for a crane adapted to be provided between a crane body and a movable support having a plurality of wheels for moving said crane along a rail, comprising:

a first pivot bearing ring consisting of a lower ring mounted on said movable support in an inclined position with respect thereto and an upper ring engaging concentrically with said lower ring so as to be rotatable with respect thereto;

an inclined beam integrally connected with said upper ring of said first pivot bearing ring;

a second pivot bearing ring consisting of a lower ring mounted on an upper face of said inclined beam at a position such that the rotational center line thereof is horizontal spaced from the rotation center line of said first pivot bearing ring, and an upper ring engaging concentrically with said lower ring so as to be rotatable with respect thereto; and a crane body connecting assembly connected between said upper ring of said second pivot bearing ring and a lower portion of said crane body.

39. A seismic isolation system for a crane according to claim 38, wherein said crane body connecting assembly comprises a hinge pin connecting member and a hydraulic cylinder, said hinge pin and said hydraulic cylinder being adapted to be mounted between the upper ring of said second pivot bearing ring and said crane body.

40. A seismic isolation system for a crane according to claim 38 comprising a releasable connector adapted to be connected to said movable support and said inclined beam and restraining rotation of said inclined beam, said releasable connector being releasable in response to a seismic force to allow rotation of said inclined beam with respect to said movable support, and a damper adapted to be mounted between said inclined beam and said movable support and being adapted to restrain rotation of said inclined beam.

41. A seismic isolation system for a crane according to claim 39 comprising a releasable connector adapted to be connected to said movable support and said inclined beam and restraining rotation of said inclined beam, said releasable connector being releasable in response to a seismic force to allow rotation of said inclined beam with respect to said movable support, and a damper adapted to be mounted between said inclined beam and said movable support and being adapted to restrain rotation of said inclined beam.

42. A seismic isolation system for a crane adapted to be provided between a crane body and a movable support having a plurality of wheels for moving said crane body along a rail, comprising:

a spring damper adapted to be connected between said crane body and said movable support and adapted to elastically maintain a predetermined positional relationship between said crane body and said movable support; and a connecting assembly adapted to be connected between said crane body and said movable support comprising a first pivot bearing ring including a lower ring adapted to be mounted horizontally on said movable support and an upper ring engaging concentrically with said lower ring so as to be rotatable with respect thereto, a horizontal beam integrally connected with said upper ring of said first pivot bearing ring, a second pivot bearing ring comprising a lower ring mounted on an upper face of said horizontal beam and being positioned to have a rotational center line at a position spaced horizontally from the rotational center line of said first pivot bearing ring, said second pivot bearing ring additionally including an upper ring engaging concentrically with said lower ring of said second pivot bearing ring so as to be rotatable with respect thereto, and a crane body connecting assembly adapted to be connected between the upper ring of said second pivot bearing ring and a lower portion of said crane body.

43. A seismic isolation system for a crane according to claim 42 additionally comprising a releasable connector connected between said horizontal beam and said movable support to restrain rotation of said horizontal beam, said releasable connector being releasable in response to a predetermined seismic force to allow rotation of said horizontal beam with respect to said movable support.

* * * * *

UNITED STATES PATENT AND TRADEMARK OFFICE

CERTIFICATE OF CORRECTION

PATENT NO. : 6,367,390 B1
DATED : April 9, 2002
INVENTOR(S) : Okubo et al.

It is certified that error appears in the above-identified patent and that said Letters Patent is hereby corrected as shown below:

Title page,
Item [56], References Cited, U.S. PATENT DOCUMENTS,
"4,382,143" should read -- 4,382,413 --.
FOREIGN PATENT DOCUMENTS,
"6/1997" should read -- 12/1998 --;
"8-33081" should read -- 8-333081 --.

Column 25,
Line 18, "mavable" should read -- movable --.

Column 28,
Line 27, after "adapted" insert -- to --.

Signed and Sealed this

Eighth Day of April, 2003

JAMES E. ROGAN
*Director of the United States Patent and Trademark Office*